US011796931B2

(12) United States Patent
Takei et al.

(10) Patent No.: US 11,796,931 B2
(45) Date of Patent: Oct. 24, 2023

(54) TONER, METHOD FOR MANUFACTURING TONER, DEVELOPER, TONER ACCOMMODATING UNIT, IMAGE FORMING APPARATUS, AND IMAGE FORMING METHOD

(71) Applicant: RICOH COMPANY, LTD., Tokyo (JP)

(72) Inventors: Akio Takei, Shizuoka (JP); Takahiro Honda, Shizuoka (JP); Tsukiko Takahashi, Shizuoka (JP); Tsuneyasu Nagatomo, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 106 days.

(21) Appl. No.: 17/060,289

(22) Filed: Oct. 1, 2020

(65) Prior Publication Data

US 2021/0116830 A1 Apr. 22, 2021

(30) Foreign Application Priority Data

Oct. 18, 2019 (JP) ..... 2019-191349

(51) Int. Cl.
*G03G 9/083* (2006.01)
*G03G 9/087* (2006.01)
(Continued)

(52) U.S. Cl.
CPC ..... *G03G 9/08773* (2013.01); *G03G 9/0804* (2013.01); *G03G 9/0827* (2013.01);
(Continued)

(58) Field of Classification Search
CPC ..... G03G 9/09307; G03G 9/09708; G03G 9/09725
See application file for complete search history.

(56) References Cited

U.S. PATENT DOCUMENTS

2004/0146795 A1 7/2004 Emoto et al.
2004/0209181 A1 10/2004 Higuchi et al.
(Continued)

FOREIGN PATENT DOCUMENTS

JP 9-146293 6/1997
JP 2002-214833 7/2002
(Continued)

OTHER PUBLICATIONS

Translation of JP 2017-156542.*
(Continued)

*Primary Examiner* — Peter L Vajda
(74) *Attorney, Agent, or Firm* — Grüneberg and Myers PLLC

(57) ABSTRACT

A toner is provided. The toner comprises colored particles and external additives present on surfaces of the colored particles. The colored particles each comprise a core and a shell layer. The core contains a crystalline resin, a non-crystalline resin, and a colorant. The shell layer contains a resin and has a thickness of from 30 to 130 nm. The external additives comprise a metal oxide and a silicon compound. An electronegativity X(A) of the metal oxide and an electronegativity X(Si) of the silicon compound satisfy a relation $0.5 \leq X(A)/X(Si) \leq 0.8$. A proportion of an amount of the metal oxide directly adhered to the surfaces of the colored particles to a total amount of the metal oxide present on the colored particles is from 60% to 90% by mass.

20 Claims, 5 Drawing Sheets

(51) Int. Cl.
*G03G 9/08* (2006.01)
*G03G 9/09* (2006.01)
*G03G 15/16* (2006.01)

(52) U.S. Cl.
CPC ..... *G03G 9/0832* (2013.01); *G03G 9/0833* (2013.01); *G03G 9/08711* (2013.01); *G03G 9/09* (2013.01); *G03G 15/163* (2013.01)

(56) References Cited

U.S. PATENT DOCUMENTS

2004/0229147 A1 11/2004 Higuchi et al.
2005/0112488 A1 5/2005 Yamada et al.
2005/0186498 A1 8/2005 Honda et al.
2006/0063081 A1 3/2006 Nagatomo et al.
2006/0204883 A1 9/2006 Nakayama et al.
2006/0245794 A1 11/2006 Honda et al.
2007/0218385 A1 9/2007 Kojima et al.
2007/0218387 A1 9/2007 Ishii et al.
2007/0218389 A1 9/2007 Honda et al.
2007/0275315 A1 11/2007 Nagatomo et al.
2008/0063971 A1 3/2008 Watanabe et al.
2008/0070144 A1 3/2008 Nagatomo et al.
2008/0227000 A1 9/2008 Honda et al.
2008/0227003 A1 9/2008 Honda et al.
2008/0227015 A1 9/2008 Nagatomo et al.
2008/0233505 A1 9/2008 Nagatomo et al.
2008/0268366 A1 10/2008 Nakayama et al.
2008/0286679 A1 11/2008 Norikane et al.
2008/0292985 A1 11/2008 Suzuki et al.
2009/0017392 A1 1/2009 Higuchi et al.
2009/0117486 A1 5/2009 Watanabe et al.
2009/0123186 A1 5/2009 Sugiura et al.
2009/0142093 A1 6/2009 Sawada et al.
2009/0142094 A1 6/2009 Sawada et al.
2009/0142685 A1 6/2009 Nagatomo et al.
2009/0239170 A1 9/2009 Honda et al.
2009/0325100 A1 12/2009 Watanabe et al.
2010/0003613 A1 1/2010 Honda et al.
2010/0021209 A1 1/2010 Watanabe et al.
2010/0055590 A1 3/2010 Honda et al.
2010/0075243 A1 3/2010 Shimota et al.
2010/0075245 A1 3/2010 Watanabe et al.
2010/0081075 A1 4/2010 Watanabe et al.
2010/0104970 A1 4/2010 Norikane et al.
2010/0233609 A1 9/2010 Higuchi et al.
2010/0297548 A1 11/2010 Honda et al.
2010/0310980 A1 12/2010 Sugimoto et al.
2011/0033794 A1 2/2011 Watanabe et al.
2011/0081608 A1 4/2011 Yaguchi et al.
2011/0151372 A1 6/2011 Watanabe et al.
2011/0200928 A1 8/2011 Watanabe et al.
2011/0294058 A1 12/2011 Shiba et al.
2013/0022371 A1 1/2013 Kusahara et al.
2013/0130171 A1 5/2013 Watanabe et al.
2013/0196260 A1 8/2013 Yoshida et al.
2013/0196261 A1 8/2013 Uchinokura et al.
2013/0196266 A1 8/2013 Watanabe et al.
2013/0216944 A1 8/2013 Shiba et al.
2013/0224648 A1 8/2013 Honda et al.
2013/0243488 A1 9/2013 Kojima et al.
2013/0244155 A1 9/2013 Satoh et al.
2013/0244156 A1 9/2013 Kojima et al.
2013/0244158 A1 9/2013 Awamura et al.
2014/0072349 A1 3/2014 Sakashita et al.
2014/0140731 A1 5/2014 Hozumi et al.
2014/0220485 A1 8/2014 Kojima et al.
2014/0234767 A1 8/2014 Awamura et al.
2014/0270874 A1 9/2014 Hase et al.
2014/0348546 A1 11/2014 Kojima et al.
2015/0104739 A1 4/2015 Nagatomo et al.
2015/0378272 A1 12/2015 Hase et al.
2016/0195828 A1 7/2016 Satoh et al.
2016/0266507 A1 9/2016 Watanabe et al.
2016/0334722 A1 11/2016 Makabe et al.
2016/0378006 A1 12/2016 Itoh et al.
2018/0052403 A1 2/2018 Inoue et al.
2018/0181014 A1 6/2018 Makabe et al.
2019/0033735 A1* 1/2019 Tasaki ..... G03G 9/09725
2019/0243291 A1 8/2019 Matsuda et al.
2019/0271927 A1 9/2019 Inoue et al.
2020/0103775 A1 4/2020 Kitagawa et al.
2020/0272066 A1 8/2020 Satoh et al.
2020/0301308 A1 9/2020 Makabe et al.

FOREIGN PATENT DOCUMENTS

JP 2005-338814 12/2005
JP 2006-293295 10/2006
JP 2009-301026 12/2009
JP 2010-181439 8/2010
JP 2011-107366 6/2011
JP 2012-203369 10/2012
JP 2015-011131 * 1/2015 ..... G03G 9/08
JP 2017-156542 * 9/2017 ..... G03G 9/0825
JP 2019-151507 * 9/2019 ..... G03G 9/097
JP 2019-159001 9/2019

OTHER PUBLICATIONS

Translation of JP 2015-011131.*
Translation of JP 2019-151507.*
U.S. Appl. No. 16/961,093, filed Jul. 9, 2020 Akio Takei, et al.
Japanese Office Action dated May 30, 2023, in Japanese Patent Application No. 2019-191349, 4 pages.

* cited by examiner

TONER, METHOD FOR MANUFACTURING TONER, DEVELOPER, TONER ACCOMMODATING UNIT, IMAGE FORMING APPARATUS, AND IMAGE FORMING METHOD

CROSS-REFERENCE TO RELATED APPLICATIONS

This patent application is based on and claims priority pursuant to 35 U.S.C. § 119(a) to Japanese Patent Application No. 2019-191349, filed on Oct. 18, 2019, in the Japan Patent Office, the entire disclosure of which is hereby incorporated by reference herein.

BACKGROUND

Technical Field

The present disclosure relates to a toner, a method for manufacturing the toner, a developer, a toner accommodating unit, an image forming apparatus, and an image forming method.

Description of the Related Art

In the electrophotographic industry, technical development for low-temperature fixing of toner is still being made day by day in response to the need for reduction of environmental load such as downsizing of image forming apparatus and reduction of power consumption.

Various technical developments have been made so far for low-temperature fixing of toner. For example, a method of controlling thermal properties of resins themselves is known. However, lowering the Tg (glass transition temperature) of resins causes deterioration of heat-resistant storage stability and fixing strength. Further, lowering the softening temperature [$T(F_{1/2})$] of resins contained in toner by lowering the molecular weights thereof causes undesirable phenomena such as hot offset and excessive gloss (due to poor gloss controllability).

Under these circumstances, the current mainstream resin composition of low-temperature fixing toners includes a polyester resin as a main binder that has excellent low-temperature fixability and heat-resistant storage stability, in place of a styrene-acrylic resin that has been widely used conventionally, and a crystalline polyester resin as a sub-binder that exhibits a sharply-melting property at the time of being fixed on a recording medium.

Further, a technique of covering the surface of toner with a shell layer has been proposed in attempting to prevent the occurrence of the side effect in which filming property and storability deteriorate when using a crystalline polyester resin.

SUMMARY

In accordance with some embodiments of the present invention, a toner is provided. The toner comprises colored particles and external additives present on surfaces of the colored particles. The colored particles each comprise a core and a shell layer. The core contains a crystalline resin, a non-crystalline resin, and a colorant. The shell layer contains a resin and has a thickness of from 30 to 130 nm. The external additives comprise a metal oxide and a silicon compound. An electronegativity X(A) of the metal oxide and an electronegativity X(Si) of the silicon compound satisfy a relation $0.5 \leq X(A)/X(Si) \leq 0.8$. A proportion of an amount of the metal oxide directly adhered to the surfaces of the colored particles to a total amount of the metal oxide present on the colored particles is from 60% to 90% by mass.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
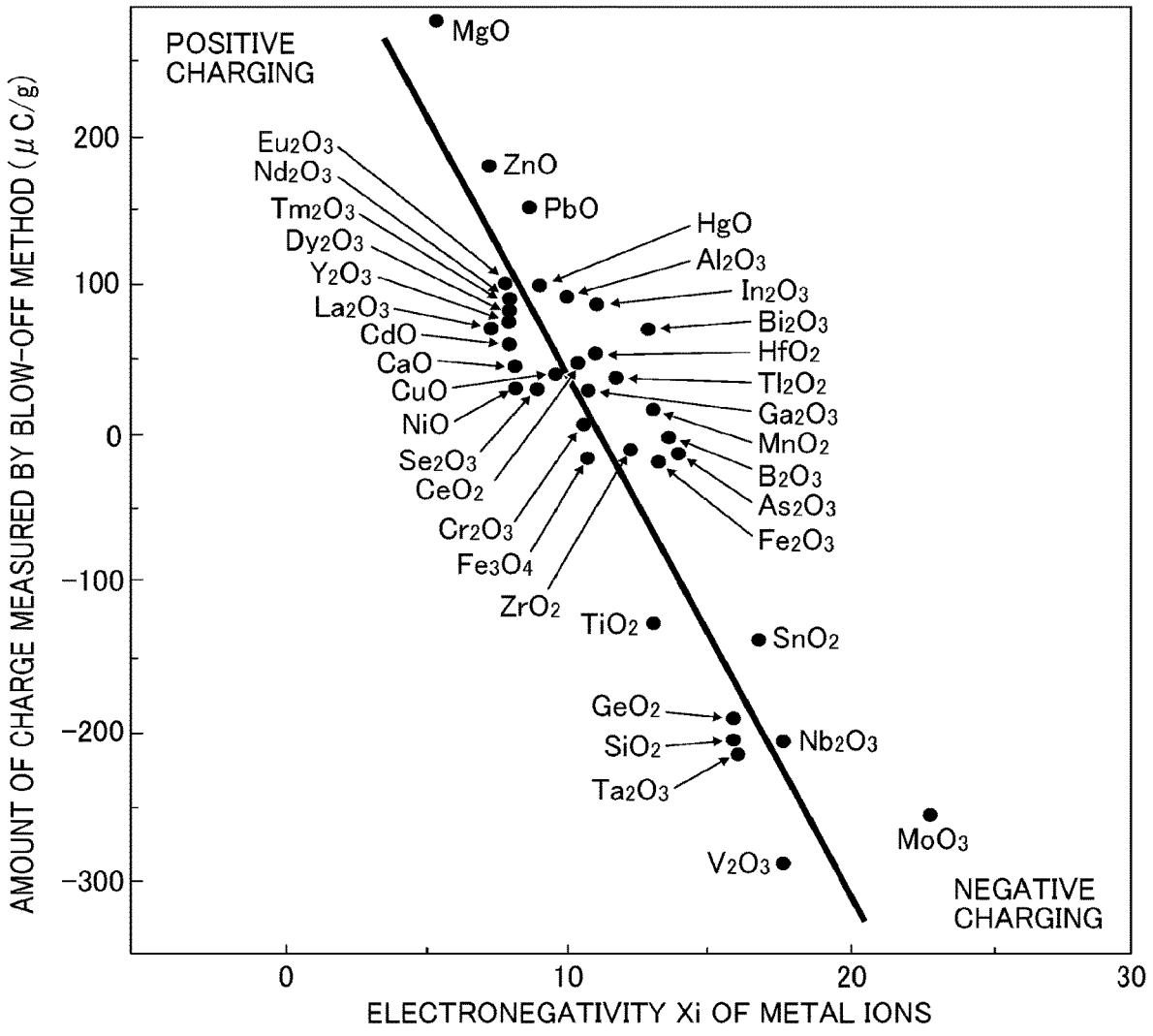
FIG. 1 is a graph showing a relation between the amount of charge of metal oxides in contact charging with iron powder, measured by a blow-off method, and the electronegativity of metal ions.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with some embodiments of the present invention, a toner is provided that has excellent low-temperature fixability and heat-resistant storage stability and is unlikely to cause image fog and photoconductor filming.

Embodiments of the present invention are described in detail below.

Toner

A toner according to an embodiment of the present invention comprises colored particles and external additives present on surfaces of the colored particles. The colored particles each comprise a core and a shell layer on a surface of the core. The core contains a crystalline resin, a non-crystalline resin, and a colorant. The shell layer contains a resin and has a thickness of from 30 to 130 nm. The external additives comprise a metal oxide and a silicon compound, and an electronegativity X(A) of the metal oxide and an electronegativity X(Si) of the silicon compound satisfy a relation $0.5 \leq X(A)/X(Si) \leq 0.8$. A proportion of an amount of the metal oxide directly adhered to the surfaces of the colored particles to a total amount of the metal oxide present on the colored particles is from 60% to 90% by mass. The toner may further contain other components as necessary.

Conventionally, inclusion of a crystalline polyester resin in toner has been effective in developing low-temperature fixability. However, at the same time, this causes side effects such as inhibition of chargeability and heat-resistant storage stability of the toner and deterioration of fluidity due to an increase of the interparticle adhesive force between toner particles.

Formation of a shell layer on the surface of toner is effective for improving heat-resistant storage stability and fluidity. However, this reduces the stability of external additives and causes the external additives to detach from toner particles due to stress, resulting in poor image quality with the occurrence of image fog, photoconductor filming, or the like.

The toner according to an embodiment of the present invention comprises colored particles each having a core and a shell layer on the surface of the core, and external additives adhered to the colored particles. The external additives comprise a silicon compound and a metal oxide. The metal oxide is serving as an intermediary for making the silicon compound appropriately present on the surfaces of the colored particles. When the proportion (adhesion rate) of the amount of the metal oxide directly adhered to the surfaces of the colored particles to the total amount of the metal oxide present on the colored particles is controlled to be within the range of from 60% to 90% by mass, and further the thickness of the shell layer and the electronegativity ratio between the metal oxide and the silicon compound are controlled to be in specific ranges, the above-described problems can be solved, providing a toner that has excellent low-temperature fixability and heat-resistant storage stability and is unlikely to cause image fog and photoconductor filming.

In the present disclosure, the shell layer is observed by the freeze fracture method. The freeze fracture method involves fracturing a physically-fixed frozen sample, subjecting the fractured surface to vapor deposition, and observing the resulted replica film. The thickness of the shell layer is determined by measuring the thickness of the shell layer at three points apart by 120° from each other in the observed image and averaging the measured values.

When the thickness of the shell layer is within a range of from 30 to 130 nm, sufficient heat-resistant storage stability is achieved without impairing low-temperature fixability. When the thickness is less than 30 nm, stability of the shell layer is lowered to expose the core, resulting in a significant deterioration in heat-resistant storage stability. When the thickness exceeds 130 nm, low-temperature fixability remarkably deteriorates. More preferably, the thickness of the shell layer is in the range of from 50 to 100 nm.

For further improving the effect of the present invention, the shell layer preferably contains styrene-acrylic resin particles having a volume average particle diameter of from 30 to 80 nm.

The volume average particle diameter can be measured using a NANOTRAC Particle Size Analyzer UPA-EX150 (manufactured by Nikkiso Co., Ltd., employing dynamic light scattering method/laser Doppler method). Specifically, a dispersion liquid in which resin particles are dispersed is subjected to the measurement while the concentration thereof is adjusted to be within the measurement concentration range. The background is measured in advance with the blank dispersion solvent. The resin particles used in the present disclosure, which have a volume average particle diameter of several tens nm to several μm, can be measured by the above procedure.

The volume average particle diameter of the resin particles contained in the shell layer is preferably from 30 to 80 nm. When the volume average particle diameter is 80 nm or less, it becomes easy to fix the external additives. When the volume average particle diameter is 30 nm or more, the resin particles are prevented to adhering to each other, improving dispersibility.

In the present disclosure, the external additives comprise a metal oxide and a silicon compound, and an electronegativity X(A) of the metal oxide and an electronegativity X(Si) of the silicon compound satisfy a relation $0.5 \leq X(A)/X(Si) \leq 0.8$. The proportion of the amount of the metal oxide directly adhered to the surfaces of the colored particles to the total amount of the metal oxide present on the colored particles is from 60% to 90% by mass.

The present inventors have found that when the electronegativity ratio [X(A)/X(Si)] between the metal oxide and the silicon compound contained in the external additives is 0.5 or more and 0.8 or less, more preferably 0.5 or more and 0.6 or less, both chargeability and fluidity can be achieved without being impaired even when the crystalline resin is present on the surfaces of the colored particles for ensuring low-temperature fixability.

Although the reason for this is not clear, it is assumed as follows. The electronegativity of the metal oxide is apart from the electronegativity of the silicon compound more than a certain amount, and the metal oxide exhibits a weak negative chargeability or a weak positive chargeability while the silicon compound exhibits a negative chargeability. When the colored particles also exhibit a negative chargeability, the metal oxide is more likely to selectively adhere to the surfaces of the colored particles than the silicon compound due to their relationship in tribo-electric series. It is assumed that the arrangement of the metal oxide and the silicon compound, in this order, on the surfaces of the colored particles is selectively formed because the colored particles and the silicon compound also electrically attract to each other. As a result, the functions of the external additives are exhibited to reliably maintain chargeability and fluidity for an extended period of time.

When the electronegativity ratio [X(A)/X(Si)] is 0.5 or more, chargeability of the metal oxide is appropriate, charge stability is good, and a high quality image can be obtained. When the electronegativity ratio [X(A)/X(Si)] is 0.8 or less, the above-described arrangement is sufficiently formed, and chargeability and fluidity are reliably maintained over an extended period of time.

Here, the electronegativity refers to the ability of atoms participating in an intramolecular bond to attract electrons. FIG. 1 is a graph showing a relation between the amount of charge of metal oxides in contact charging with iron powder, measured by a blow-off method, and the electronegativity of metal ions. The electronegativity of various metal oxides used as external additives of toners is material-specific and widely known. For example, alumina ($Al_2O_3$) is electrically positive and capable of electrostatically attracting silica ($SiO_2$) that is electrically negative.

In the toner according to an embodiment of the present invention, the proportion of the amount of the metal oxide directly adhered to the surfaces of the colored particles to the total amount of the metal oxide present on the colored particles is from 60% to 90% by mass. Here, "the metal oxide present on the colored particles" include the metal oxide (X1) which is directly adhered to the surfaces of the colored particles and the metal oxide (X2) which is indirectly adhered (for example, adhered via silicon oxide or another metal oxide) to the colored particles.

When the adhesion rate of the metal oxide is 60% by mass or more, the external additives can be properly arranged. When the adhesion rate of the metal oxide is 90% by mass or less, fluidity of the toner is good.

Adhesion Rate (%) of Metal Oxide Directly Adhered to Surfaces of Colored Particles to All Metal Oxide Present on Colored Particles The amount (X1) of the metal oxide directly adhered to the surfaces of the colored particles and the total amount (Y=X1+X2) of the metal oxide present on the colored particles can be measured as described below, and the adhesion rate (%) of the metal oxide directly adhered to the surfaces of the colored particles can be obtained from the formula (X1/Y)×100.

Amount (X1) of Metal Oxide Directly Adhered to Surfaces of Colored Particles (1) First, 5 g of a polyoxyalkylene alkyl ether (NOIGEN ET-165, manufactured by DKS Co., Ltd.) is weighed in a 500-mL beaker. Next, 300 mL of distilled water are added thereto and sonicated for dissolution. The resulting solution is transferred to a 1,000-mL volumetric flask and distilled water is added thereto to make 1,000 mL (and allow to stand for a while if foaming occurs), followed by sonication for blending, to prepare a 0.5% by mass dispersion liquid of the polyoxyalkylene alkyl ether (NOIGEN ET-165, manufactured by DKS Co., Ltd.).

(2) Next, 3.75 g of a toner sample are dispersed in 50 mL of the 0.5% by mass dispersion liquid of the polyoxyalkylene alkyl ether (NOIGEN ET-165, manufactured by DKS Co., Ltd.) in a 110-mL vial.

(3) Using an ultrasonic homogenizer (trade name: HOMOGENIZER, model VCX750, CV33, manufactured by Sonics & Materials, Inc.), ultrasonic waves are emitted with an emission energy amount of 4.8 kJ for a certain time at a frequency of 20 kHz and an output of 80 W. The emission energy amount is calculated from the product of the output and the emission time. These treatments are carried out while appropriately cooling the toner particle dispersion liquid so that the liquid temperature thereof does not exceed 40 degrees C.

(4) The resulted dispersion liquid is suction filtered with a filter paper (trade name: qualitative filter paper (No. 2, 110 mm), available from Advantec Toyo Kaisha, Ltd.), washed again with ion-exchange water twice, and filtered. After removing the metal oxide, the toner particles are dried.

(5) The proportion (% by mass) of the metal oxide adhered to the surfaces of the toner particles after the removal of the metal oxide is quantified by a measurement using an X-ray fluorescence analyzer (ZSX-100e, manufactured by Rigaku Corporation) and a calibration curve showing the intensity (or the difference in intensity before and after the removal of the metal oxide), thus determining the amount (X1) of the metal oxide directly adhered to the surfaces of the colored particles in the toner.

Total Amount (Y) of Metal Oxide Present on Colored Particles

The total amount (Y) of the metal oxide present on the colored particles can be measured as follows.

Using an ultrasonic homogenizer, ultrasonic waves with an emission energy amount of 1,000 kJ and 1,500 kJ are emitted to the toner particles in the same manner as above. The toner particles are then subjected to the quantification of the metal oxide using an X-ray fluorescence analyzer to confirm whether there is a decrease in the amount of the metal oxide between the measurements at 1,000 kJ and 1,500 kJ.

When there is no decrease, it can be confirmed that all the metal oxide has been desorbed from the toner particles. It is also possible to confirm that all the metal oxide has been desorbed by observing the surfaces of the toner particles using a field emission scanning electron microscope (FE-SEM) after the treatment.

When there is a change observed, the emission energy amount is further increased by 500 kJ and the same treatment is performed.

From the difference between the amount of metal oxide present on the surfaces of the toner particles from which all the metal oxide has been desorbed in the above-described manner and the amount of metal oxide present on the surfaces of the untreated toner particles from which the metal oxide has not been desorbed, the total amount (Y) of the metal oxide present on the colored particles of the toner can be calculated.

After desorbing all the metal oxide in the above-described manner, "the amount of metal oxide in the colored particles from which all the metal oxide has been desorbed" measured by an X-ray fluorescence analyzer may be zero, or a certain value in a case in which the colored particles contain a metal-oxide-containing material. On the other hand, the amount of metal oxide in the untreated toner particles measured by an X-ray fluorescence analyzer is a total amount of the metal oxide as the external additive and a metal-oxide-containing material, if any, in the colored particles.

Thus, the total amount of the metal oxide present on the colored particles in the toner is calculated from, as described above, the difference between the total amount of metal oxide in the toner and the amount of metal oxide on the surface of the colored particles from which all the metal oxide has been desorbed.

The proportion of the amount of the metal oxide directly adhered to the surfaces of the colored particles to the total amount of the metal oxide present on the colored particles can be controlled to be from 60% to 90% by mass by, for example, controlling the peripheral speed of a mixer and/or the mixing time at the time of mixing.

The toner according to an embodiment of the present invention comprises colored particles and external additives present on surfaces of the colored particles. The colored particles each comprise a core and a shell layer on a surface of the core. The core contains a crystalline resin, a non-crystalline resin, and a colorant. The toner may further contain other components as necessary.

External Additives

The external additives contain a silicon compound and a metal oxide, and may further contain other particles, if necessary.

The ratio (X(A)/X(Si)) of the electronegativity X(A) of the metal oxide and the electronegativity X(Si) of the silicon compound satisfies, as described above, the relation $0.5 \leq X(A)/X(Si) \leq 0.8$.

Metal Oxide

Specific examples of the metal oxide include, but are not limited to, aluminum oxide, zinc oxide, cerium oxide, and zirconium oxide. Each of these can be used alone or in combination with others. Among these, aluminum oxide is preferred.

The metal oxide preferably has a sphericity, represented by the following formula (1), of 0.5 or more. When the metal oxide having a sphericity of 0.5 or more are present on the colored particles, the adhesive force between the toner particles can be well reduced due to a spacer effect.

$$\text{Sphericity} = 4\pi A/L^2 \qquad \text{Formula (1)}$$

In the formula (1), π represents the ratio of the circumference of a circle to a diameter of the circle, A represents an area of a projected image of a particle of the metal oxide, and L represents a circumferential length of the projected image.

The sphericity of the metal oxide can be determined by observing primary particles of the metal oxide being dispersed in the toner particles with a scanning electron microscope (SEM) and analyzing an image of the primary particles of the metal oxide. The image analysis can be performed as follows using an image analysis software program LMeye for OPTELICS C130 manufactured by Lasertec Corporation.

(1) Capture an image observed at 5.0 kV using the SEM.
(2) Adjust the calibration (scale).
(3) Perform automatic contrast.
(4) Invert.
(5) Perform edge extraction (Sobel).
(6) Perform edge extraction (Sobel) again.
(7) Perform binarization processing (discriminant analysis mode).
(8) Calculate shape features (sphericity, absolute maximum length, diagonal width) by measurement.

The sphericity of the metal oxide is 50% sphericity in the cumulative frequency of the equivalent circle diameters of 100 primary particles of the metal oxide obtained by the image analysis.

Silicon Compound

Specific examples of the silicon compound include, but are not limited to, silicon oxide (silica), silicon carbide, silicon nitride, and silicon tetrachloride. Each of these can be used alone or in combination with others. Among these, silicon oxide (silica) is preferred.

The silicon oxide preferably has a number average particle diameter of 50 nm or more and 200 nm or less.

When the number average particle diameter is 50 nm or more, the silicon oxide is suitably used as a spacer material, durability is improved, and image quality is good over time. When the number average particle diameter is 200 nm or less, fluidity and chargeability are good.

The other particles are not particularly limited and can be suitably selected to suit to a particular application, but hydrophobized inorganic particles are preferred.

The other particles may have, for example, a spherical shape, an acicular shape, or an aspherical shape in which several spherical particles are coalesced.

The other particles are not particularly limited and can be suitably selected to suit to a particular application. Examples thereof include, but are not limited to, fatty acid metal salts (e.g., zinc stearate, aluminum stearate) and fluoropolymers.

Colored Particles

The colored particles contain a crystalline resin, a non-crystalline resin, and a colorant, and may further contain other components as necessary.

In the toner, the amount of the crystalline resin is preferably 6 parts by mass or more with respect to 100 parts by mass of the non-crystalline resin. When the amount of the crystalline resin is 6 parts by mass or more, low-temperature fixability of the toner is improved.

Crystalline Resin

"Crystallinity" refers to a property of being capable of sharply softening by heat and of having a ratio (i.e., softening temperature/temperature at maximum peak of heat of fusion) of the softening temperature measured by a flowtester to the temperature at the maximum peak of heat of fusion measured by a differential scanning calorimeter (DSC) of preferably from 0.80 to 1.55. A resin having this property is referred to as a "crystalline resin".

"Non-crystallinity" refers to a property of being capable of gently softening by heat and of having the ratio (i.e., softening temperature/temperature at maximum peak of heat of fusion) of the softening temperature to the temperature at the maximum peak of heat of fusion of more than 1.55. A resin having this property is referred to as a "non-crystalline resin".

The softening temperature of resins and toners can be measured using a capillary rheometer flowtester (e.g., CFT-500D manufactured by Shimadzu Corporation).

Specifically, 1 g of a sample (resin or toner) is applied with a load of 3.0 kg/cm$^2$ by a plunger while being heated at a temperature rising rate of 3 degrees C./min, then extruded from a nozzle having a diameter of 0.5 mm and a length of 1 mm. The amount of decent of the plunger in the flowtester is plotted against the temperature to draw a curve on a graph, and a temperature at which half of the sample has been flowed out is defined as the softening temperature.

The temperature at the maximum peak of heat of fusion of resins and toners can be measured by a differential scanning calorimeter (hereinafter "DSC", e.g., TA-60WS and DSC-60 manufactured by Shimadzu Corporation).

Specifically, after a sample to be subjected to a measurement of the temperature at the maximum peak of heat of fusion is melted at 130 degrees C. as a pretreatment, the temperature is lowered from 130 degrees C. to 70 degrees C. at a rate of 1.0 degree C./minute, and further lowered from 70 degrees C. to 10 degrees C. at a rate of 0.5 degrees C./minute.

The temperature is then raised at a temperature rising rate of 20 degrees C./minute to measure endothermic and exothermic changes by DSC. A graph showing the relation between the "endothermic and exothermic amounts" and the "temperature" is drawn, and an endothermic peak temperature observed in a range of from 20 to 100 degrees C. is defined as "Ta*".

When multiple endothermic peaks are observed, the temperature at the peak with the largest endothermic amount is defined as Ta*. After that, the sample is stored at a temperature of (Ta*−10) degrees C. for 6 hours and further at a temperature of (Ta*−15) degrees C. for 6 hours. Next, the sample is cooled to 0 degrees C. at a temperature falling rate of 10 degrees C./minute by DSC, then heated at a temperature rising rate of 20 degrees C./minute, to measure endothermic and exothermic changes. The graph is drawn in the same manner as above, and the temperature at the maximum peak of the endothermic and exothermic amounts is defined as the temperature at the maximum peak of heat of fusion in the second heating. The amount of heat of fusion can be calculated from the area (peak area) from the temperature at which the endotherm starts to the temperature at which the endotherm ends.

In the present disclosure, for improving the effect, it is preferable that the crystalline resin be a crystalline polyester resin and the non-crystalline resin be a non-crystalline polyester resin.

Crystalline Polyester Resin

The crystalline polyester resin (hereinafter "crystalline polyester resin C") has a high degree of crystallinity and therefore exhibits a heat melting property showing a rapid change in viscosity at around the fixing start temperature. When used in combination with the non-crystalline polyester resin, the crystalline polyester resin C can maintain good storage stability below the melting start temperature due to its crystallinity, but upon reaching the melting start temperature, the crystalline polyester resin C melts and undergoes a rapid decrease in viscosity ("sharply-melting property"). The crystalline polyester resin C then compatibilizes with the non-crystalline polyester resin B (to be described later) and together undergoes a rapid decrease in viscosity to be fixed on a recording medium. Thus, the toner exhibits excellent heat-resistant storage stability and low-temperature fixability. Such a toner also exhibits a wide releasable range (i.e., the difference between the lower-limit fixable temperature and the high-temperature offset resistant temperature).

The crystalline polyester resin C is obtained from a polyol and a polycarboxylic acid or its derivative (e.g., polycarboxylic acid anhydride, polycarboxylic acid ester).

In the present disclosure, the crystalline polyester resin C refers to a resin obtained from a polyol and a polycarboxylic acid or its derivative (e.g., polycarboxylic acid anhydride, polycarboxylic acid ester), as described above. Modified polyester resins, such as prepolymers (to be described later) and resins obtained by cross-linking and/or elongating the prepolymers, do not fall within the scope of the crystalline polyester resin C of the present disclosure.

Polyol

The polyol is not particularly limited and can be suitably selected to suit to a particular application. Examples of the polyol include, but are not limited to, diols and trivalent or higher alcohols.

Examples of the diols include, but are not limited to, saturated aliphatic diols. Examples of the saturated aliphatic diols include, but are not limited to, straight-chain saturated aliphatic diols and branched saturated aliphatic diols. Among these, straight-chain saturated aliphatic diols are preferred, and straight-chain saturated aliphatic diols having 2 to 12 carbon atoms are more preferred. The branched saturated aliphatic diols may lower crystallinity of the crystalline polyester resin C and may further lower the melting point thereof. Saturated aliphatic diols having more than 12 carbon atoms are not easily available. Thus, the number of carbon atoms is preferably 12 or less.

Specific examples of the saturated aliphatic diols include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanediol. Each of these can be used alone or in combination with others. Among these, ethylene glycol, 1,4-butanediol, 1,6-hexanediol, 1,8-octanediol, 1,10-decanediol, and 1,12-dodecanediol are preferred for making the crystalline polyester resin C have high crystallinity and sharply-melting property.

Examples of the trivalent or higher alcohols include, but are not limited to, glycerin, trimethylolethane, trimethylolpropane, and pentaerythritol.

Each of these polyols may be used alone or in combination with others.

Polycarboxylic Acid

The polycarboxylic acid is not particularly limited and can be suitably selected to suit to a particular application. Examples of the polycarboxylic acid include, but are not limited to, divalent carboxylic acids and trivalent or higher carboxylic acids.

Examples of the dicarboxylic acids include, but are not limited to: saturated aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids such as diprotic acids such as phthalic acid, isophthalic acid, terephthalic acid, naphthalene-2,6-dicarboxylic acid, malonic acid, and mesaconic acid; and anhydrides and lower alkyl esters (C1-C3) thereof.

Examples of the trivalent or higher carboxylic acids include, but are not limited to, 1,2,4-benzenetricarboxylic acid, 1,2,5-benzenetricarboxylic acid, 1,2,4-naphthalenetricarboxylic acid, and anhydrides and lower alkyl esters (C1-C3) thereof.

The polycarboxylic acid may further include a dicarboxylic acid having sulfo group, other than the above-described saturated aliphatic dicarboxylic acids and aromatic dicarboxylic acids. In addition, the polycarboxylic acid may further include a dicarboxylic acid having a double bond, other than the above-described saturated aliphatic dicarboxylic acids and aromatic dicarboxylic acids.

Each of these polycarboxylic acids can be used alone or in combination with others.

Preferably, the crystalline polyester resin C comprises a straight-chain saturated aliphatic dicarboxylic acid having 4 to 12 carbon atoms and a straight-chain saturated aliphatic diol having 2 to 12 carbon atoms. In other words, preferably, the crystalline polyester resin C has a structural unit derived from a saturated aliphatic dicarboxylic acid having 4 to 12 carbon atoms and another structural unit derived from a saturated aliphatic diol having 2 to 12 carbon atoms. Such a crystalline polyester resin C has high crystallinity and sharply-melting property and thus exerts excellent low-temperature fixability, which is preferable.

The melting point of the crystalline polyester resin C is not particularly limited and can be suitably selected to suit to a particular application, but is preferably in the range of from 60 to 80 degrees C. When the melting point is lower than 60 degrees C., the crystalline polyester resin C is likely to melt at low temperatures, resulting in deterioration of heat-resistant storage stability of the toner. When the melting point is higher than 80 degrees C., the crystalline polyester resin C insufficiently melts upon application of heat at the time of fixing the toner, resulting in deterioration of low-temperature fixability.

The molecular weight of the crystalline polyester resin C is not particularly limited and can be suitably selected to suit to a particular application. As the molecular weight distribution becomes narrower and the molecular weight becomes lower, low-temperature fixability improves. As the amount of low-molecular-weight components increases, heat-resistant storage stability deteriorates. In view of this, preferably, ortho-dichlorobenzene-soluble matter in the crystalline polyester resin C has a weight average molecular weight (Mw) of from 3,000 to 30,000 and a number average molecular weight (Mn) of from 1,000 to 10,000, and a ratio Mw/Mn of from 1.0 to 10, as measured by GPC (gel permeation chromatography).

More preferably, the weight average molecular weight (Mw) is from 5,000 to 15,000, the number average molecular weight (Mn) is from 2,000 to 10,000, and the ratio Mw/Mn is from 1.0 to 5.0.

The acid value of the crystalline polyester resin C is not particularly limited and can be suitably selected to suit to a particular application, but is preferably 5 mgKOH/g or more, more preferably 10 mgKOH/g or more, for achieving a desired level of low-temperature fixability in terms of affinity for paper. On the other hand, for improving high-temperature offset resistance, the acid value is preferably 45 mgKOH/g or less.

The hydroxyl value of the crystalline polyester resin C is not particularly limited and can be suitably selected to suit to a particular application, but is preferably in the range of from 0 to 50 mgKOH/g, more preferably from 5 to 50 mgKOH/g, for achieving a desired level of low-temperature fixability and a good level of chargeability.

The molecular structure of the crystalline polyester resin C can be determined by, for example, solution or solid NMR (nuclear magnetic resonance), X-ray diffractometry, GC/MS (gas chromatography-mass spectroscopy), LC/MS (liquid chromatography-mass spectroscopy), or IR (infrared spectroscopy). For example, IR can simply detect the crystalline polyester resin C as a substance showing an absorption peak based on δCH (out-of-plane bending vibration) of olefin at 965±10 $cm^{-1}$ or 990±10 $cm^{-1}$ in an infrared absorption spectrum.

The amount of the crystalline polyester resin C in the toner is not particularly limited and can be suitably selected to suit to a particular application. Preferably, the amount of the crystalline polyester resin C in 100 parts by mass of the toner is from 3 to 20 parts by mass, more preferably from 5 to 15 parts by mass. When the amount is 3 parts by mass or more, sharply-melting property of the crystalline polyester resin C is achieved, and low-temperature fixability is improved. When the amount is 20 parts by mass or less, heat-resistant storage stability is excellent, and high-quality images are provided.

Non-crystalline Polyester Resin

The non-crystalline polyester resin is not particularly limited and can be suitably selected to suit to a particular application, but preferably includes a non-crystalline polyester resin A and a non-crystalline polyester resin B.

Non-crystalline Polyester Resin A

The non-crystalline polyester resin A is not particularly limited and can be suitably selected to suit to a particular application, but preferably has a glass transition temperature (Tg) in the range of from −40 to 20 degrees C.

The non-crystalline polyester resin A is not particularly limited and can be suitably selected to suit to a particular application, but is preferably obtained by a reaction between a non-linear reactive precursor and a curing agent.

Preferably, the non-crystalline polyester resin A has at least one of urethane bond and urea bond for exhibiting excellent adhesion property to recording media such as paper. When the non-crystalline polyester resin A has at least one of urethane bond and urea bond, the urethane bond and/or urea bond behave as pseudo cross-linked points, thereby enhancing rubber property of the non-crystalline polyester resin A and improving heat-resistant storage stability and high-temperature offset resistance of the toner.

Non-linear Reactive Precursor

The non-linear reactive precursor is not particularly limited and can be suitably selected to suit to a particular application as long as it is a polyester resin having a group reactive with the curing agent (hereinafter "prepolymer").

The group reactive with the curing agent in the prepolymer may be, for example, a group reactive with an active hydrogen group. Examples of the group reactive with an active hydrogen group include, but are not limited to, isocyanate group, epoxy group, carboxyl group, and an acid chloride group. Among these, isocyanate group is preferred because urethane bond or urea bond can be introduced into the resulting non-crystalline polyester resin.

The prepolymer is non-linear. Being non-linear refers to having a branched structure formed with at least one of a trivalent or higher alcohol and a trivalent or higher carboxylic acid.

Preferably, the prepolymer is a polyester resin having an isocyanate group.

The polyester resin having an isocyanate group is not particularly limited and can be suitably selected to suit to a particular application. Examples thereof include, but are not limited to, a reaction product of a polyester resin having an active hydrogen group with a polyisocyanate. The polyester resin having an active hydrogen group may be obtained by, for example, a polycondensation of a diol, a dicarboxylic acid, and at least one of a trivalent or higher alcohol and a trivalent or higher carboxylic acid. The trivalent or higher alcohol and the trivalent or higher carboxylic acid impart a branched structure to the resulting polyester resin having isocyanate group.

The diol is not particularly limited and can be suitably selected to suit to a particular application. Specific examples thereof include, but are not limited to: aliphatic diols such as ethylene glycol, 1,2-propylene glycol, 1,3-propylene glycol, 1,4-butanediol, 3-methyl-1,5-pentanediol, 1,6-hexanediol, 1,8-octanediol, 1,10-decanediol, and 1,12-dodecanediol; oxyalkylene-group-containing diols such as diethylene glycol, triethylene glycol, dipropylene glycol, polyethylene glycol, polypropylene glycol, and polytetramethylene glycol; alicyclic diols such as 1,4-cyclohexanedimethanol and hydrogenated bisphenol A; alkylene oxide (e.g., ethylene oxide, propylene oxide, and butylene oxide) adducts of alicyclic diols; bisphenols such as bisphenol A, bisphenol F, and bisphenol S; and alkylene oxide (e.g., ethylene oxide, propylene oxide, and butylene oxide) adducts of bisphenols. Among these, aliphatic diols having 4 to 12 carbon atoms are preferred.

Each of these diols can be used alone or in combination with others.

The dicarboxylic acid is not particularly limited and can be suitably selected to suit to a particular application. Examples thereof include, but are not limited to, aliphatic dicarboxylic acids and aromatic dicarboxylic acids. In addition, anhydrides, lower alkyl (C1-C3) esters, and halides thereof may also be used.

The aliphatic dicarboxylic acids are not particularly limited and can be suitably selected to suit to a particular application. Specific examples thereof include, but are not limited to, succinic acid, adipic acid, sebacic acid, dodecanedioic acid, maleic acid, and fumaric acid.

The aromatic dicarboxylic acids are not particularly limited and can be suitably selected to suit to a particular application. Specific preferred examples thereof include, but are not limited to, aromatic dicarboxylic acids having 8 to 20 carbon atoms. The aromatic dicarboxylic acids having 8 to 20 carbon atoms are not particularly limited and can be suitably selected to suit to a particular application. Specific examples thereof include, but are not limited to, phthalic acid, isophthalic acid, terephthalic acid, and naphthalenedicarboxylic acid.

Among these, aliphatic dicarboxylic acids having 4 to 12 carbon atoms are preferred.

Each of these dicarboxylic acids can be used alone or in combination with others.

The trivalent or higher alcohol is not particularly limited and can be suitably selected to suit to a particular application. Examples thereof include, but are not limited to, trivalent or higher aliphatic alcohols, trivalent or higher polyphenols, and alkylene oxide adducts of trivalent or higher polyphenols.

Examples of the trivalent or higher aliphatic alcohols include, but are not limited to, glycerin, trimethylolethane, trimethylolpropane, pentaerythritol, and sorbitol.

Examples of the trivalent or higher polyphenols include, but are not limited to, trisphenol PA, phenol novolac, and cresol novolac.

Examples of the alkylene oxide adducts of trivalent or higher polyphenols include, but are not limited to, alkylene oxide (e.g., ethylene oxide, propylene oxide, and butylene oxide) adducts of trivalent or higher polyphenols.

Preferably, the non-crystalline polyester resin A contains a trivalent or higher aliphatic alcohol as a constituent.

When containing a trivalent or higher aliphatic alcohol as a constituent, the non-crystalline polyester resin A is given a branched structure in its molecular framework. Thus, the molecular chain of the amorphous polyester resin A takes a three-dimensional network structure that exhibits rubber-like property being deformable but not flowable at low temperatures. Accordingly, heat-resistant storage stability and high-temperature offset resistance of the toner can be maintained.

The non-crystalline polyester resin A may also contain a trivalent or higher carboxylic acid, epoxy, or the like as a cross-linking component. In the case of a carboxylic acid, specifically an aromatic compound in many cases, the ester bond density in the cross-linked portion becomes high, which may cause the image formed by fixing the toner by heat exhibit insufficient gloss. In the case of using a cross-linking agent such as epoxy, the cross-linking reaction is carried out after the polyester has been polymerized. Therefore, it is difficult to control the distance between cross-linking points to achieve a desired viscoelasticity. In addition, since the cross-linking agent is likely to react with an oligomer at the time of producing the polyester to form a portion having a high cross-linking density, the resulting fixed image may have unevenness, low gloss, and low image density.

The trivalent or higher carboxylic acid is not particularly limited and can be suitably selected to suit to a particular application. Examples thereof include, but are not limited to, trivalent or higher aromatic carboxylic acids. In addition, anhydrides, lower alkyl (C1-C3) esters, and halides thereof may also be used.

Preferred examples of the trivalent or higher aromatic carboxylic acids include trivalent or higher aromatic carboxylic acids having 9 to 20 carbon atoms. Examples of the trivalent or higher aromatic carboxylic acids having 9 to 20 carbon atoms include, but are not limited to, trimellitic acid and pyromellitic acid.

The polyisocyanate is not particularly limited and can be suitably selected to suit to a particular application. Examples thereof include, but are not limited to, diisocyanates and trivalent or higher isocyanates.

Specific examples of the diisocyanates include, but are not limited to, aliphatic diisocyanates, alicyclic diisocyanates, aromatic diisocyanates, araliphatic diisocyanates, isocyanurates, and these diisocyanates blocked with a phenol derivative, oxime, or caprolactam.

The aliphatic diisocyanates are not particularly limited and can be suitably selected to suit to a particular application. Examples thereof include, but are not limited to, tetramethylene diisocyanate, hexamethylene diisocyanate, methyl 2,6-diisocyanatocaproate, octamethylene diisocyanate, decamethine diisocyanate, dodecamethylene diisocyanate, tetradecamethylene diisocyanate, trimethylhexane diisocyanate, and tetramethylhexane diisocyanate.

The alicyclic diisocyanates are not particularly limited and can be suitably selected to suit to a particular application. Examples thereof include, but are not limited to, isophorone diisocyanate and cyclohexylmethane diisocyanate.

The aromatic diisocyanates are not particularly limited and can be suitably selected to suit to a particular application. Examples thereof include, but are not limited to, tolylene diisocyanate, diisocyanatodiphenylmethane, 1,5-naphthylene diisocyanate, 4,4'-diisocyanatodiphenyl, 4,4'-diisocyanato-3,3'-dimethyldiphenyl, 4,4'-diisocyanato-3-methyldiphenylmethane, and 4,4'-diisocyanato-diphenyl ether.

The araliphatic diisocyanates are not particularly limited and can be suitably selected to suit to a particular application. Examples thereof include, but are not limited to, $\alpha,\alpha,\alpha',\alpha'$-tetramethylxylylene diisocyanate.

The isocyanurates are not particularly limited and can be suitably selected to suit to a particular application. Examples thereof include, but are not limited to, tris(isocyanatoalkyl) isocyanurate and tris(isocyanatocycloalkyl) isocyanurate.

Each of these polyisocyanates can be used alone or in combination with others.

Curing Agent

The curing agent is not particularly limited and can be suitably selected to suit to a particular application as long as it is reactive with the non-linear reactive precursor to produce the non-crystalline polyester resin A. Specific examples of the curing agent include, but are not limited to, a compound having an active hydrogen group.

Compound Having Active Hydrogen Group

The active hydrogen group in the compound is not particularly limited and can be suitably selected to suit to a particular application. Examples thereof include, but are not limited to, hydroxyl groups (e.g., alcoholic hydroxyl group, phenolic hydroxyl group), amino group, carboxyl group, and mercapto group. Each of these can be used alone or in combination with others.

The compound having an active hydrogen group is not particularly limited and can be suitably selected to suit to a particular application, but is preferably an amine, because amines are capable of forming urea bond.

The amine is not particularly limited and can be suitably selected to suit to a particular application. Examples thereof include, but are not limited to, diamines, trivalent or higher amines, amino alcohols, amino mercaptans, amino acids, and these amines in which the amino group is blocked. Each of these can be used alone or in combination with others.

In particular, a diamine alone and a mixture of a diamine with a small amount of a trivalent or higher amine are preferred.

The diamines are not particularly limited and can be suitably selected to suit to a particular application. Examples thereof include, but are not limited to, aromatic diamines, alicyclic diamines, and aliphatic diamines. The aromatic diamines are not particularly limited and can be suitably selected to suit to a particular application. Examples thereof include, but are not limited to, phenylenediamine, diethyltoluenediamine, and 4,4'-diaminodiphenylmethane. The alicyclic diamines are not particularly limited and can be suitably selected to suit to a particular application. Examples thereof include, but are not limited to, 4,4'-diamino-3,3'-dimethyldicyclohexylmethane, diaminocyclohexane, and isophoronediamine. The aliphatic diamines are not particularly limited and can be suitably selected to suit to a particular application. Examples thereof include, but are not limited to, ethylenediamine, tetramethylenediamine, and hexamethylenediamine.

The trivalent or higher amines are not particularly limited and can be suitably selected to suit to a particular application. Examples thereof include, but are not limited to, diethylenetriamine and triethylenetetramine.

The amino alcohols are not particularly limited and can be suitably selected to suit to a particular application. Examples thereof include, but are not limited to, ethanolamine and hydroxyethylaniline.

The amino mercaptans are not particularly limited and can be suitably selected to suit to a particular application. Examples thereof include, but are not limited to, aminoethyl mercaptan and aminopropyl mercaptan.

The amino acids are not particularly limited and can be suitably selected to suit to a particular application. Examples thereof include, but are not limited to, aminopropionic acid and aminocaproic acid.

The amines in which the amino group is blocked are not particularly limited and can be suitably selected to suit to a particular application. Examples thereof include, but are not limited to, ketimine compounds obtained by blocking the amino group with a ketone such as acetone, methyl ethyl ketone, and methyl isobutyl ketone, and oxazoline compounds.

To lower the Tg of the non-crystalline polyester resin A to make it easier to impart low-temperature deformability, the non-crystalline polyester resin A preferably contains diol components as constituents, which comprise an aliphatic diol having 4 to 12 carbon atoms in an amount of 50% by mass or more.

Furthermore, to lower the Tg of the non-crystalline polyester resin A to make it easier to impart low-temperature deformability, the non-crystalline polyester resin A preferably contains alcohol components comprising an aliphatic diol having 4 to 12 carbon atoms in an amount of 50% by mass or more.

To lower the Tg of the non-crystalline polyester resin A to make it easier to impart low-temperature deformability, the non-crystalline polyester resin A preferably contains dicarboxylic acid components as constituents, which comprise an aliphatic dicarboxylic acid having 4 to 12 carbon atoms in an amount of 50% by mass or more.

The weight average molecular weight of the non-crystalline polyester resin A is not particularly limited and can be suitably selected to suit to a particular application, but is preferably from 20,000 to 1,000,000, more preferably from 50,000 to 300,000, particularly preferably from 100,000 to 200,000, as measured by GPC (gel permeation chromatography). When the weight average molecular weight is less than 20,000, the toner becomes more flowable at low temperatures, resulting in poor heat-resistant storage stability. In addition, viscoelasticity of the toner becomes too low when the toner melts, resulting in deterioration of high-temperature offset resistance.

The molecular structure of the non-crystalline polyester resin A can be determined by, for example, solution or solid NMR (nuclear magnetic resonance), X-ray diffractometry, GC/MS (gas chromatography-mass spectroscopy), LC/MS (liquid chromatography-mass spectroscopy), or IR (infrared spectroscopy). For example, IR can simply detect a non-crystalline polyester resin as a substance showing no absorption peak based on δCH (out-of-plane bending vibration) of olefin at 965±10 $cm^{-1}$ and 990±10 $cm^{-1}$ in an infrared absorption spectrum.

The amount of the non-crystalline polyester resin A in the toner is not particularly limited and can be suitably selected to suit to a particular application. Preferably, the amount of the non-crystalline polyester resin Ain 100 parts by mass of the toner is from 5 to 25 parts by mass, more preferably from 10 to 20 parts by mass. When the amount is less than 5 parts by mass, low-temperature fixability and high-temperature offset resistance may deteriorate. When the amount is greater than 25 parts by mass, heat-resistant storage stability may deteriorate and the gloss of the fixed image may decrease. When the amount is within the preferred range, low-temperature fixability, high-temperature offset resistance, and heat-resistant storage stability are all excellent.

Non-Crystalline Polyester Resin B

The non-crystalline polyester resin B preferably has a glass transition temperature (Tg) of from 40 to 80 degrees C.

Preferably, the non-crystalline polyester resin B is a linear polyester resin.

Preferably, the non-crystalline polyester resin B is an unmodified polyester resin. Here, the unmodified polyester resin refers to a polyester resin that is obtained from a polyol and a polycarboxylic acid or its derivative (e.g., polycarboxylic acid anhydride, polycarboxylic acid ester) and that is unmodified with an isocyanate compound or the like.

The non-crystalline polyester resin B preferably has neither a urethane bond nor a urea bond.

Preferably, the non-crystalline polyester resin B comprises dicarboxylic acid components as constituents, which comprise terephthalic acid in an amount of 50% by mol or more. This configuration is advantageous in terms of heat-resistant storage stability.

Examples of the polyol include, but are not limited to, diols.

Specific examples of the diols include, but are not limited to: alkylene (C2-C3) oxide adducts of bisphenol A with an average addition molar number of 1 to 10, such as polyoxypropylene(2.2)-2,2-bis(4-hydroxyphenyl)propane and polyoxyethylene(2.2)-2,2-bis(4-hydroxyphenyl)propane; ethylene glycol and propylene glycol; and hydrogenated bisphenol A and alkylene (C2-C3) oxide adducts of hydrogenated bisphenol A with an average addition molar number of 1 to 10.

Each of these can be used alone or in combination with others.

Examples of the polycarboxylic acid include, but are not limited to, dicarboxylic acids.

Specific examples of the dicarboxylic acids include, but are not limited to: adipic acid, phthalic acid, isophthalic acid, terephthalic acid, fumaric acid, and maleic acid; and succinic acid derivatives substituted with an alkyl group having 1 to 20 carbon atoms or an alkenyl group having 2 to 20 carbon atoms, such as dodecenyl succinic acid and octyl succinic acid. Each of these can be used alone or in combination with others.

For the purpose of adjusting the acid value and/or hydroxyl value, the non-crystalline polyester resin B may contain, at a terminal of the resin chain, at least one of a trivalent or higher carboxylic acid and a trivalent or higher alcohol.

Specific examples of the trivalent or higher carboxylic acid include, but are not limited to, trimellitic acid, pyromellitic acid, and acid anhydrides thereof.

Specific examples of the trivalent or higher alcohol include, but are not limited to, glycerin, pentaerythritol, and trimethylolpropane.

The molecular weight of the non-crystalline polyester resin B is not particularly limited and can be suitably selected to suit to a particular application. However, if the molecular weight is too low, heat-resistant storage stability and durability (i.e., resistance to stresses, such as that caused by stirring in a developing device) of the toner will be poor. If the molecular weight is too high, viscoelasticity of the toner when melted will be high and low-temperature fixability will be poor. Therefore, the weight average molecular weight (Mw) is preferably from 3,000 to 10,000 as measured by GPC (gel permeation chromatography). The number average molecular weight (Mn) is preferably from 1,000 to 4,000. The ratio Mw/Mn is preferably from 1.0 to 4.0.

More preferably, the weight average molecular weight (Mw) is from 4,000 to 7,000. More preferably, the number average molecular weight (Mn) is from 1,500 to 3,000. More preferably, the ratio Mw/Mn is from 1.0 to 3.5.

The acid value of the non-crystalline polyester resin B is not particularly limited and can be suitably selected to suit to a particular application, but is preferably from 1 to 50 mgKOH/g, more preferably from 5 to 30 mgKOH/g. When the acid value is 1 mgKOH/g or higher, the toner becomes more negatively-chargeable and more compatible with paper when being fixed thereon, thereby improving low-temperature fixability. When the acid value is 50 mgKOH/g or lower, charge stability, particularly charge stability against environmental fluctuation, is good.

The hydroxyl value of the non-crystalline polyester resin B is not particularly limited and can be suitably selected to suit to a particular application, but it is preferably 5 mgKOH/g or more.

The glass transition temperature (Tg) of the non-crystalline polyester resin B is preferably from 40 to 80 degrees C., more preferably from 50 to 70 degrees C. When the glass transition temperature is 40 degrees C. or higher, heat-resistant storage stability and durability (i.e., resistance to stress such as that caused by stirring in a developing device) of the toner, as well as filming resistance of the toner, are good. When the glass transition temperature is 80 degrees C. or lower, the toner sufficiently deforms when fixed by application of heat and pressure, and low-temperature fixability is good.

The molecular structure of the non-crystalline polyester resin B can be determined by, for example, solution or solid NMR (nuclear magnetic resonance), X-ray diffractometry, GC/MS (gas chromatography-mass spectroscopy), LC/MS (liquid chromatography-mass spectroscopy), or IR (infrared spectroscopy). For example, IR can simply detect a non-crystalline polyester resin as a substance showing no absorption peak based on δCH (out-of-plane bending vibration) of olefin at 965±10 $cm^{-1}$ and 990±10 $cm^{-1}$ in an infrared absorption spectrum.

The amount of the non-crystalline polyester resin B in the toner is not particularly limited and can be suitably selected to suit to a particular application. Preferably, the amount of the non-crystalline polyester resin B in 100 parts by mass of the toner is from 50 to 90 parts by mass, more preferably from 60 to 80 parts by mass. When the amount is less than 50 parts by mass, the dispersibility of colorants and release agents in the toner may be poor, and image fog or disturbance may be caused. When the amount is greater than 90 parts by mass, the amounts of the crystalline polyester resin C and the non-crystalline polyester resin A are so small that low-temperature fixability may be poor. When the amount is within the preferred range, image quality and low-temperature fixability are all excellent.

To further improve low-temperature fixability, it is preferable that the non-crystalline polyester resin A and the crystalline polyester resin C be used in combination. To achieve both low-temperature fixability and high-temperature high-humidity storability, the non-crystalline polyester resin A preferably has a very low glass transition temperature. When the glass transition temperature is very low, the non-crystalline polyester resin A is deformable at low temperatures. Specifically, the non-crystalline polyester resin A is deformable upon application of heat and pressure at the time of fixing and becomes more adhesive to a recording medium such as paper at much lower temperatures. The non-crystalline polyester resin A may have a branched structure in its molecular framework because its reactive precursor is non-linear. The molecular chain takes a three-dimensional network structure that exhibits rubber-like property being deformable but not flowable at low temperatures. Accordingly, heat-resistant storage stability and high-temperature offset resistance of the toner can be maintained.

When the non-crystalline polyester resin A has at least one of urethane bond and urea bond having high cohesive energy, adhesion property to recording media such as paper is more excellent. The urethane bond and/or urea bond behave as pseudo cross-linked points, thereby enhancing rubber property and improving heat-resistant storage stability and high-temperature offset resistance of the toner.

When the non-crystalline polyester resin A and the crystalline polyester resin C, optionally together with the non-crystalline polyester resin B, are used in combination, low-temperature fixability of the toner is very excellent. When the non-crystalline polyester resin A has an ultra low glass transition temperature, it is possible to maintain heat-resistant storage stability and high-temperature offset resistance even when the glass transition temperature of the toner is set low. In addition, low-temperature fixability is excellent due to the low glass transition temperature of the toner.

Colorant

The colorant is not particularly limited and can be suitably selected to suit to a particular application. Specific examples thereof include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Each of these can be used alone or in combination with others.

The amount of the colorant in the toner is not particularly limited and can be suitably selected to suit to a particular application. Preferably, the amount of the colorant in 100 parts by mass of the toner is from 1 to 15 parts by mass, more preferably from 3 to 10 parts by mass.

The colorant can be combined with a resin to be used as a master batch. Examples of the resin to be used for manufacturing the master batch or kneaded with the master batch include, but are not limited to: the above-described non-crystalline polyester resins; polymers of styrene or substitutes thereof, such as polystyrene, poly p-chlorostyrene, and polyvinyl toluene; styrene-based copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl a-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleate copolymer; and polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Each of these can be used alone or in combination with others.

The master batch can be obtained by mixing and kneading the resin and the colorant while applying a high shearing force thereto. To increase the interaction between the colorant and the resin, an organic solvent may be used. More specifically, the maser batch can be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried. Preferably, the mixing and kneading is performed by a high shearing dispersing device such as a three roll mill.

Polymerization of Shell Resin

Styrene-Acrylic Resin

Examples of the styrene-acrylic resin include a polymer obtained by copolymerizing two or more arbitrary types of styrene-based and acrylic-based monomers in an arbitrary ratio. Specific examples thereof include, but are not limited to, styrene-(meth)acrylate copolymers, styrene-(meth) acrylic acid copolymers, styrene-(meth)acrylic acid-divinylbenzene copolymers, styrene-styrenesulfonic acid-(meth) acrylate copolymers.

Here, the styrene-based monomers refer to aromatic compounds having a vinyl polymerizable functional group.

Specific examples of the vinyl polymerizable functional group include, but are not limited to, vinyl group, isopropenyl group, allyl group, acryloyl group, and methacryloyl group.

Specific examples of the styrene-based monomers include, but are not limited to, styrene, α-methylstyrene, 4-methylstyrene, 4-ethylstyrene, 4-tert-butylstyrene, 4-methoxystyrene, 4-ethoxystyrene, 4-carboxystyrene and metal salts thereof, 4-styrenesulfonic acid and metal salts thereof, 1-vinylnaphthalene, 2-vinylnaphthalene, allylbenzene, phenoxyalkylene glycol acrylate, phenoxyalkylene glycol methacrylate, phenoxypolyalkylene glycol acrylate, and phenoxypolyalkylene glycol methacrylate.

Among these monomers, styrene is preferred because it is easily available and has high reactivity and chargeability.

Specific examples of (meth)acrylic monomers include, but are not limited to: acrylic acid and derivatives thereof, such as acrylic acid, methyl acrylate, ethyl acrylate, n-propyl acrylate, isopropyl acrylate, n-butyl acrylate, isobutyl acrylate, n-octyl acrylate, dodecyl acrylate, stearyl acrylate, 2-ethylhexyl acrylate, and tetrahydrofurfuryl acrylate; and methacrylic acid and derivatives thereof, such as methyl methacrylate, ethyl methacrylate, n-propyl methacrylate, isopropyl methacrylate, n-butyl methacrylate, isobutyl methacrylate, n-octyl methacrylate, dodecyl methacrylate, stearyl methacrylate, 2-ethylhexyl methacrylate, and tetrahydrofurfuryl methacrylate.

Preferably, 85% to 65% by mass of styrene and 15% to 35% by mass of acrylic monomers are polymerized. Particularly preferably, 90% to 80% by mass of styrene and 10% to 20% by mass of acrylic monomers are polymerized.

Acrylic Resin

Specific examples of (meth)acrylic monomers include, but are not limited to: acrylic acid and derivatives thereof, such as acrylic acid, methyl acrylate, ethyl acrylate, n-propyl acrylate, isopropyl acrylate, n-butyl acrylate, isobutyl acrylate, n-octyl acrylate, dodecyl acrylate, stearyl acrylate, 2-ethylhexyl acrylate, and tetrahydrofurfuryl acrylate; and methacrylic acid and derivatives thereof, such as methyl methacrylate, ethyl methacrylate, n-propyl methacrylate, isopropyl methacrylate, n-butyl methacrylate, isobutyl methacrylate, n-octyl methacrylate, dodecyl methacrylate, stearyl methacrylate, 2-ethylhexyl methacrylate, and tetrahydrofurfuryl methacrylate.

Each of these (meth)acrylic monomers may be used alone or in combination of others.

Among the above-described (meth)acrylic monomers, methyl methacrylate is most preferred.

Other Components

Examples of the other components include, but are not limited to, a release agent, a charge controlling agent, a fluidity improving agent, a cleanability improving agent, and a magnetic material.

Release Agent

The release agent is not particularly limited and can be suitably selected to suit to a particular application. Examples thereof include, but are not limited to, waxes, particularly natural waxes such as plant waxes (e.g., carnauba wax, cotton wax, sumac wax, rice wax), animal waxes (e.g., beeswax, lanolin), mineral waxes (e.g., ozokerite, ceresin), and petroleum waxes (e.g., paraffin wax, microcrystalline wax, petrolatum wax).

Examples of the release agent further include, but are not limited to, synthetic hydrocarbon waxes (e.g., Fischer-Tropsch wax, polyethylene wax, polypropylene wax) and synthetic waxes (e.g., ester wax, ketone wax, ether wax).

Examples of the release agent further include: fatty acid amide compounds such as 12-hydroxystearic acid amide, stearic acid amide, phthalic anhydride imide, and chlorinated hydrocarbon; homopolymers and copolymers of polyacrylates (e.g., poly-n-stearyl methacrylate, poly-n-lauryl methacrylate), which are low-molecular-weight crystalline polymers, such as copolymer of n-stearyl acrylate and ethyl methacrylate; and crystalline polymers having a long alkyl side chain.

Among these materials, hydrocarbon waxes such as paraffin wax, micro-crystalline wax, Fischer-Tropsch wax, polyethylene wax, and polypropylene wax are preferred.

The melting point of the release agent is not particularly limited and can be suitably selected to suit to a particular application, but is preferably in the range of from 60 to 80 degrees C. When the melting point is 60 degrees C. or higher, heat-resistant storage stability is good. When the melting point is 80 degrees C. or lower, high-quality images are provided.

The amount of the release agent in the toner is not particularly limited and can be suitably selected to suit to a particular application. Preferably, the amount of the release agent in 100 parts by mass of the toner is from 2 to 10 parts by mass, more preferably from 3 to 8 parts by mass.

Charge Controlling Agent

The charge controlling agent is not particularly limited and can be suitably selected to suit to a particular application. Examples thereof include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkyl amides, phosphorus and phosphorus-containing compounds, tungsten and tungsten-containing compounds, fluorine activators, metal salts of salicylic acid, and metal salts of salicylic acid derivatives.

Specific examples thereof include, but are not limited to: BONTRON 03 (nigrosine dye), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product), available from Orient Chemical Industries Co., Ltd.; TP-302 and TP-415 (molybdenum complexes of quaternary ammonium salts), available from Hodogaya Chemical Co., Ltd.; LRA-901, and LR-147 (boron complex), available from Japan Carlit Co., Ltd.; and cooper phthalocyanine, perylene, quinacridone, azo pigments, and polymeric compounds having a functional group such as a sulfo group, a carboxyl group, and a quaternary ammonium group.

The amount of the charge controlling agent in the toner is not particularly limited and can be suitably selected to suit to a particular application. Preferably, the amount of the charge controlling agent in 100 parts by mass of the toner is from 0.1 to 10 parts by mass, more preferably from 0.2 to 5 parts by mass.

Fluidity Improving Agent

The fluidity improving agent is not particularly limited and can be suitably selected to suit to a particular application as long as it reforms a surface to improve hydrophobicity for preventing deterioration of fluidity and chargeability even under high-humidity environments. Specific examples thereof include, but are not limited to, silane coupling agents, silylation agents, silane coupling agents having a fluorinated alkyl group, organic titanate coupling agents, aluminum coupling agents, silicone oils, and modified silicone oils. Preferably, the above-described silica and titanium oxide are surface-treated with such a fluidity improving agent to become hydrophobic silica and hydrophobic titanium oxide, respectively.

Cleanability Improving Agent

The cleanability improving agent is not particularly limited and can be suitably selected to suit to a particular application as long as it is an additive that facilitates easy removal of the toner remaining on a photoconductor or primary transfer medium after image transfer. Specific examples thereof include, but are not limited to, metal salts of fatty acids (e.g., zinc stearate and calcium stearate) and fine particles of polymers prepared by soap-free emulsion polymerization (e.g., polymethyl methacrylate and polystyrene). Preferably, the particle size distribution of the fine particles of polymers is as narrow as possible. More preferably, the volume average particle diameter thereof is in the range of from 0.01 to 1 μm.

Magnetic Material

The magnetic material is not particularly limited and can be suitably selected to suit to a particular application. Examples thereof include, but are not limited to, iron powder, magnetite, and ferrite. In particular, those having white color tone are preferred.

Method for Manufacturing Toner

A method for manufacturing the toner according to an embodiment of the present invention is described below for the purpose of illustration and not limitation. A method for manufacturing the toner according to an embodiment of the present invention includes the processes of: dissolving or dispersing a resin having at least a polyester backbone and a release agent in an organic solvent, suspending the resulting solution or dispersion in an aqueous medium to form core particles, then adding a resin dispersion liquid containing styrene-acrylic resin particles and acrylic resin particles, or adding a styrene-acrylic resin particle dispersion liquid while/after an acrylic resin particle dispersion liquid is added, to form a shell layer; and removing the organic solvent to obtain the toner.

The method for manufacturing the toner according to an embodiment of the present invention includes the processes of externally adding a metal oxide to the surfaces of colored particles and further externally adding a silicon compound on the surfaces of the colored particles (hereinafter this process may be referred to as "mixing process"), and further includes other processes as necessary.

The colored particles are preferably obtained by dispersing an oil phase containing the non-crystalline polyester resin A, the non-crystalline polyester resin B, the crystalline polyester resin C, and optionally a release agent, a colorant, and the like, in an aqueous phase.

Alternatively, the colored particles are preferably obtained by dispersing an oil phase containing the non-linear reactive precursor, the non-crystalline polyester resin B, the crystalline polyester resin C, and optionally a curing agent, a release agent, a colorant, and the like, in an aqueous medium.

As an example of such a method for manufacturing the colored particles, a dissolution suspension method is known. One method for manufacturing the colored particles is described below, which includes the process of forming toner base particles while elongating the non-crystalline polyester resin A by an elongation reaction and/or a cross-linking reaction between the prepolymer and the curing agent. This method involves the processes of preparation of an aqueous medium, preparation of an oil phase containing toner materials, emulsification or dispersion of the toner materials, and removal of an organic solvent. The colored particles thus prepared are then mixed with the external additive, thus preparing the toner.

Preparation of Aqueous Medium (Aqueous Phase)

The aqueous phase may be prepared by dispersing resin particles in an aqueous medium. The amount of the resin particles added to the aqueous medium is not particularly limited and can be suitably selected to suit to a particular application, but is preferably in the range of from 0.5 to 10 parts by mass based on 100 parts of the aqueous medium.

The aqueous medium is not particularly limited and can be suitably selected to suit to a particular application. Specific examples thereof include, but are not limited to, water, water-miscible solvents, and mixtures thereof. Each of these can be used alone or in combination with others. Among these, water is preferred.

The water-miscible solvents are not particularly limited and can be suitably selected to suit to a particular application. Examples thereof include, but are not limited to, alcohols, dimethylformamide, tetrahydrofuran, cellosolves, and lower ketones. The alcohols are not particularly limited and can be suitably selected to suit to a particular application. Examples thereof include, but are not limited to, methanol, isopropanol, and ethylene glycol. The lower ketones are not particularly limited and can be suitably selected to suit to a particular application. Examples thereof include, but are not limited to, acetone and methyl ethyl ketone.

Preparation of Oil Phase

The oil phase containing toner materials can be prepared by dissolving or dispersing the toner materials including at least the non-linear reactive precursor, the non-crystalline polyester resin B, and the crystalline polyester resin C, and optionally the curing agent, release agent, colorant, and the like, in an organic solvent.

The organic solvent is not particularly limited and can be suitably selected to suit to a particular application, but an organic solvent having a boiling point less than 150 degrees C. is preferred for easy removal.

The organic solvent having a boiling point less than 150 degrees C. is not particularly limited and can be suitably selected to suit to a particular application. Examples thereof include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Each of these can be used alone or in combination with others. Among these solvents, ethyl acetate, toluene, xylene, benzene, methylene chloride, 1,2-dichloroethane, chloroform, and carbon tetrachloride are preferred, and ethyl acetate is more preferred.

Emulsification or Dispersion

Emulsification or dispersion of the toner materials is performed by dispersing the oil phase containing the toner materials in the aqueous medium. At the time of emulsifying or dispersing the oil phase containing the toner materials, the non-crystalline polyester resin A is formed by an elongation reaction and/or a cross-linking reaction between the curing agent and the non-linear reactive precursor.

The non-crystalline polyester resin A may be formed by one of the following procedures (1) to (3).

(1) Emulsify or disperse an oil phase containing the non-linear reactive precursor and the curing agent in an aqueous medium, to cause an elongation reaction and/or a cross-linking reaction between the curing agent and the non-linear reactive precursor in the aqueous medium, thereby forming the non-crystalline polyester resin A.

(2) Emulsify or disperse an oil phase containing the non-linear reactive precursor in an aqueous medium to which the curing agent has been previously added, to cause an elongation reaction and/or a cross-linking reaction between the curing agent and the non-linear reactive precursor in the aqueous medium, thereby forming the non-crystalline polyester resin A.

(3) Emulsify or disperse an oil phase containing the non-linear reactive precursor in an aqueous medium and thereafter add the curing agent to the aqueous medium, to cause an elongation reaction and/or a cross-linking reaction between the curing agent and the non-linear reactive precursor in the aqueous medium from the interfaces of dispersed particles, thereby forming the non-crystalline polyester resin A.

In a case in which an elongation reaction and/or a cross-linking reaction between the curing agent and the non-linear reactive precursor is caused from the interfaces of dispersed particles, the non-crystalline polyester resin A is preferentially formed at the surface of the resulting toner while forming a concentration gradient of the non-crystalline polyester resin A within the toner.

The reaction conditions (e.g., reaction time, reaction temperature) for forming the non-crystalline polyester resin A are not limited and determined depending on the combination of the curing agent and the non-linear reactive precursor.

The reaction time is not particularly limited and can be suitably selected to suit to a particular application, but is preferably in the range of from 10 minutes to 40 hours, more preferably from 2 to 24 hours.

The reaction temperature is not particularly limited and can be suitably selected to suit to a particular application, but is preferably in the range of from 0 to 150 degrees C., more preferably from 40 to 98 degrees C.

A method for reliably forming a dispersion liquid containing the non-linear reactive precursor in the aqueous medium is not particularly limited and can be suitably selected to suit to a particular application. For example, the method may include the processes of adding to the aqueous medium an oil phase in which the toner materials are dissolved or dispersed and applying a shearing force thereto to disperse the oil phase in the aqueous medium.

A disperser for dispersing the oil phase is not particularly limited and can be suitably selected to suit to a particular application. Examples thereof include, but are not limited to, low-speed shear-type dispersers, high-speed shear-type dispersers, friction-type dispersers, high-pressure jet dispersers, and ultrasonic dispersers.

Among these dispersers, high-speed shear-type dispersers are preferred because they can adjust the particle diameter of the dispersoids (oil droplets) to 2 to 20 μm.

When the high-speed shear-type disperser is used, dispersing conditions, such as the number of revolutions, dispersing time, and dispersing temperature, can be determined depending on the purpose.

The number of revolutions is not particularly limited and can be suitably selected to suit to a particular application, but is preferably is in the range of from 1,000 to 30,000 rpm, more preferably from 5,000 rpm to 20,000 rpm.

The dispersing time is not particularly limited and can be suitably selected to suit to a particular application, but is preferably in the range of from 0.1 to 5 minutes in the case of a batch-type disperser.

The dispersing temperature is not particularly limited and can be suitably selected to suit to a particular application, but is preferably in the range of from 0 to 150 degrees C., more preferably from 40 to 98 degrees C., under pressure. Generally, as the dispersing temperature becomes higher, the dispersing becomes easier.

The amount of the aqueous medium used to emulsify or disperse the toner materials is not particularly limited and can be suitably selected to suit to a particular application, but is preferably in the range of from 50 to 2,000 parts by mass, more preferably from 100 to 1,000 parts by mass, based on 100 parts by mass of the toner materials.

When the amount of the aqueous medium used is 50 parts by mass or more, the dispersion state of the toner materials is good, and colored particles having a desired particle size may be obtained. When the amount of the aqueous medium used is 2,000 parts by mass or less, the production cost can be reduced.

Preferably, when the oil phase containing the toner materials is emulsified or dispersed in the aqueous medium, a dispersant is used to stabilize dispersoids (oil droplets) to obtain toner particles with a desired shape and a narrow particle size distribution.

The dispersant is not particularly limited and can be suitably selected to suit to a particular application. Examples thereof include, but are not limited to, surfactants, poorly-water-soluble inorganic compounds, and polymeric protection colloids. Each of these can be used alone or in combination with others. Among these, surfactants are preferred.

The surfactants are not particularly limited and can be suitably selected to suit to a particular application. Examples thereof include, but are not limited to, anionic surfactants, cationic surfactants, nonionic surfactants, and ampholytic surfactants.

The anionic surfactants are not particularly limited and can be suitably selected to suit to a particular application. Examples thereof include, but are not limited to, alkylbenzene sulfonates, α-olefin sulfonates, and phosphates. Among these surfactants, those having a fluoroalkyl group are preferred.

In the elongation reaction and/or cross-linking reaction for forming the non-crystalline polyester resin A, a catalyst may be used.

The catalyst is not particularly limited and can be suitably selected to suit to a particular application. Examples thereof include, but are not limited to, dibutyltin laurate and dioctyltin laurate.

Removal of Organic Solvent

A method for removing the organic solvent from the dispersion liquid (emulsion slurry) is not particularly limited and can be suitably selected to suit to a particular application. For example, the method may include the process of gradually raising the temperature of the reaction system to completely evaporate the organic solvent from oil droplets, or spraying the dispersion liquid into dry atmosphere to completely evaporate the organic solvent from oil droplets.

Upon removal of the organic solvent, colored particles are formed.

Shell Formation Process

In the resulting core particle dispersion liquid, liquid droplets of the core particles can be stably dispersed while the core particle dispersion liquid is being stirred. To the core particle dispersion liquid in such a state, a vinyl copolymer resin particle dispersion liquid is added to make the vinyl copolymer resin particles adhere onto the core particles. It is preferable that the vinyl copolymer resin particle dispersion liquid be added over a period of 30 seconds or more. When the addition is performed in a period of less than 30 seconds, the dispersion system may rapidly change to generate aggregated particles or the adherence of the vinyl copolymer resin particles may become non-uniform. On the other hand, it is not preferable to take too long a time for the addition, for example, over 60 minutes, in terms of production efficiency.

The vinyl copolymer resin particle dispersion liquid may be diluted or condensed to adjust the concentration before being poured into the core particle dispersion liquid. The vinyl copolymer resin particle dispersion liquid preferably has a concentration of from 5% to 30% by weight, more preferably from 8% to 20% by weight. When the concentration is less than 5% by weight, a change in organic solvent concentration upon pouring of the dispersion liquid is large, and the adherence of the resin particles to the core particles may become insufficient, which is not preferred. When the concentration is more than 30% by weight, it is likely that the resin particles are non-uniformly distributed in the core particle dispersion liquid, resulting in non-uniform adherence of the resin particles to the core particles, which is not preferred.

A reason why the vinyl copolymer resin particles adhere to the core particles with a sufficient strength by the above-described processes is considered that: 1) the vinyl copolymer resin particles sufficiently form contact surfaces with the core particles upon contact therewith because liquid droplets of the core particles are freely deformable; and that 2) the vinyl copolymer resin particles become swelled or dissolved in the organic solvent to be easily adhered to the resin contained in the core particles. Accordingly, it is necessary that a sufficient amount of the organic solvent be present in the system.

Specifically, the proportion of the organic solvent to solid contents (i.e., resin, colorant, release agent, charge controlling agent, etc.) in the core particle dispersion liquid is preferably from 50% to 150% by weight, more preferably from 70% to 125% by weight. When the proportion is more than 150% by weight, the yield of the colored resin particles in a single production process is small and the production efficiency is low. In addition, when the amount of the organic solvent is too large, the dispersion stability is lowered to make stable production difficult.

Washing and Drying Process

The resulted colored particles may be subjected to washing and drying, and further to classification. The classification may be performed in a liquid by removing ultrafine particles by cyclone separation, decantation, or centrifugal separation. Alternatively, the classification may be performed after the drying.

Mixing Process

The resulted colored particles are externally added with the external additive by mixing. After the metal oxide has been externally added to the surfaces of the colored particles, the silicon compound is further externally added to the surfaces of the colored particles. As a result, the silicon compound can be firmly immobilized on the surfaces of the colored particles.

The amount of the metal oxide added to 100 parts by mass of the colored particles is preferably from 0.2 to 1.0 parts by mass.

The amount of the silicon compound added to 100 parts by mass of the colored particles is preferably from 0.5 to 5 parts by mass.

The mixing of the external additive may be performed with a typical powder mixer, preferably equipped with a jacket for inner temperature control. To vary load history given to the external additive, the external additive may be gradually added or added from the middle of the mixing, while optionally varying the rotation number, rolling speed, time, and temperature of the mixer.

The load may be initially strong and gradually weaken, or vice versa. Specific examples of usable mixers include, but are not limited to, V-type mixer, ROCKING MIXER, LOEDIGE MIXER, NAUTA MIXER, and HENSCHEL MIXER. The colored particles are then allowed to pass a sieve having a mesh size of 250 or more so that coarse particles and aggregated particles are removed, thereby obtaining toner particles.

Developer

A developer according to an embodiment of the present invention contains the toner according to an embodiment of the present invention and a carrier.

The carrier is not particularly limited and can be suitably selected to suit to a particular application. Preferably, the carrier comprises a core material and a resin layer coating the core material.

The core material is not particularly limited and can be suitably selected to suit to a particular application. Examples thereof include, but are not limited to, manganese-strontium (Mn—Sr) materials and manganese-magnesium (Mn—Mg) materials having a magnetization of from 50 to 90 emu/g. For securing image density, high magnetization materials such as iron powders having a magnetization of 100 emu/g or more and magnetites having a magnetization of from 75 to 120 emu/g are preferred. Additionally, low magnetization materials such as copper-zinc (Cu—Zn) materials having a magnetization of from 30 to 80 emu/g are preferred for improving image quality, because such materials are capable of reducing the impact of the magnetic brush containing toner to a photoconductor. Each of these can be used alone or in combination with others.

The core material has a volume average particle diameter of preferably from 25 to 200 μm.

The material of the resin layer is not particularly limited and can be suitably selected to suit to a particular application. Examples thereof include, but are not limited to, amino resin, polyvinyl resin, polystyrene resin, halogenated olefin resin, polyester resin, polycarbonate resin, polyethylene resin, polyvinyl fluoride resin, polyvinylidene fluoride resin, polytrifluoroethylene resin, polyhexafluoropropylene resin, copolymer of vinylidene fluoride with an acrylic monomer, copolymer of vinylidene fluoride with vinyl fluoride, fluoroterpolymer (e.g., terpolymer of tetrafluoroethylene, vinylidene fluoride, and non-fluoride monomer), and silicone resin. Each of these can be used alone or in combination with others.

In a case in which the developer is a two-component developer, the mixing ratio of the toner to the carrier is preferably from 2.0% to 12.0% by mass, more preferably from 2.5 to 10.0% by mass.

Toner Accommodating Unit

A toner accommodating unit according to an embodiment of the present invention is a unit accommodating the toner in a container having a function of accommodating toner. The toner accommodating unit may be in the form of, for example, a toner accommodating container, a developing device, or a process cartridge.

The toner accommodating container refers to a container accommodating the toner.

The developing device refers to a device accommodating the toner and having a developing unit configured to develop an electrostatic latent image into a toner image with the toner.

The process cartridge refers to a combined body of an image bearer with a developing unit accommodating the toner, detachably mountable on an image forming apparatus. The process cartridge may further include at least one of a charger, an irradiator, and a cleaner.

The toner accommodating unit according to an embodiment of the present invention accommodates the toner according to an embodiment of the present invention.

When the toner accommodating unit according to an embodiment of the present invention is mounted on an image forming apparatus, an image is formed with the toner according to an embodiment of the present invention having excellent low-temperature fixability and heat-resistant storage stability. Therefore, the occurrence of image fog and photoconductor filming is extremely low.

Process Cartridge

A process cartridge according to an embodiment of the present invention includes at least an electrostatic latent image bearer configured to bear an electrostatic latent image and a developing device configured to develop the electrostatic latent image on the electrostatic latent image bearer into a visible image with toner. The process cartridge may further include other devices, such as a charger, an irradiator, a transfer device, a cleaner, and a neutralizer, as needed.

The developing device includes at least a developer accommodating container containing the toner or developer according to an embodiment of the present invention, and a developer bearer configured to bear and convey the toner or developer contained in the developer accommodating container. The developing device may further include a layer thickness regulator configured to regulate the layer thickness of the toner borne by the developer bearer.

The process cartridge is detachably mountable on electrophotographic image forming apparatuses, facsimile machines, and printers. Preferably, the process cartridge is detachably mounted on an image forming apparatus according to an embodiment of the present invention to be described later.

Image Forming Method and Image Forming Apparatus

An image forming apparatus according to an embodiment of the present invention includes at least an electrostatic latent image bearer, an electrostatic latent image forming device, and a developing device, and may further include other devices such as a neutralizer, a cleaner, a recycler, and a controller, as needed.

An image forming method according to an embodiment of the present invention includes at least an electrostatic latent image forming process and a developing process, and may further include other processes such as a neutralization process, a cleaning process, a recycle process, and a control process, as needed.

The image forming method is preferably performed by the image forming apparatus. The electrostatic latent image forming process is preferably performed by the electrostatic latent image forming device. The developing process is preferably performed by the developing device. The other processes are preferably performed by the other devices.

Electrostatic Latent Image Forming Process and Electrostatic Latent Image Forming Device The electrostatic latent image forming process is a process in which an electrostatic latent image is formed on an electrostatic latent image bearer.

The electrostatic latent image bearer (hereinafter also referred to as "electrophotographic photoconductor" or "photoconductor") is not limited in material, shape, structure, and size, and can be appropriately selected from known materials. As the shape, drum-like shape is preferred. Specific examples of the materials include, but are not limited to, inorganic photoconductors such as amorphous silicon and selenium, and organic photoconductors (OPC) such as polysilane and phthalopolymethine. Among these, organic photoconductors (OPC) are preferred for producing images with a higher definition.

The formation of the electrostatic latent image can be conducted by, for example, uniformly charging a surface of the electrostatic latent image bearer and irradiating the surface with light containing image information by the electrostatic latent image forming device.

The electrostatic latent image forming device may include at least a charger configured to uniformly charge a surface of the electrostatic latent image bearer and an irradiator configured to irradiate the surface of the electrostatic latent image bearer with light containing image information.

The charging can be conducted by, for example, applying a voltage to a surface of the electrostatic latent image bearer by the charger.

The charger is not particularly limited and can be suitably selected to suit to a particular application. Specific examples thereof include, but are not limited to, contact chargers equipped with a conductive or semiconductive roller, brush, film, or rubber blade and non-contact chargers employing corona discharge such as corotron and scorotron.

Preferably, the charger is disposed in or out of contact with the electrostatic latent image bearer and configured to charge the surface of the electrostatic latent image bearer by applying direct-current and alternating-current voltages in superimposition thereto.

Preferably, the charger is a charging roller disposed close to but out of contact with the electrostatic latent image bearer via a gap tape and configured to charge the surface of the electrostatic latent image bearer by applying direct-current and alternating-current voltages in superimposition thereto.

The irradiation can be conducted by, for example, irradiating the surface of the electrostatic latent image bearer with light containing image information by the irradiator.

The irradiator is not particularly limited and can be suitably selected to suit to a particular application as long as it can irradiate the surface of the electrostatic latent image bearer charged by the charger with light containing information of an image to be formed. Specific examples thereof include, but are not limited to, various irradiators of radiation optical system type, rod lens array type, laser optical type, and liquid crystal shutter optical type.

The irradiation can also be conducted by irradiating the back surface of the electrostatic latent image bearer with light containing image information.

Developing Process and Developing Device

The developing process is a process in which the electrostatic latent image is developed with the toner to form a visible image.

The visible image can be formed by developing the electrostatic latent image with the toner by the developing device.

Preferably, the developing device includes a developing unit storing the toner and is configured to apply the toner to the electrostatic latent image by contacting or without contacting the electrostatic latent image. More preferably, the developing unit is equipped with a container containing the toner.

The developing device may be either a monochrome developing device or a multicolor developing device. Preferably, the developing device includes a stirrer that frictionally stirs and charges the toner and a rotatable magnet roller.

Transfer Process and Transfer Device

The transfer process is a process in which the visible image is transferred onto a recording medium. It is preferable that the visible image is primarily transferred onto an intermediate transferor and then secondarily transferred onto the recording medium. Specifically, the transfer process includes a primary transfer process in which the visible image formed with two or more toners with different colors, preferably in full colors, is transferred onto the intermediate transferor to form a composite transferred image, and a secondary transfer process in which the composite transferred image is transferred onto the recording medium.

The transfer device (including the primary transfer device and the secondary transfer device) preferably includes a transferrer configured to separate the visible image formed on the electrostatic latent image bearer (photoconductor) to the recording medium side by charging. The number of the transfer devices is at least one, and may be two or more.

Specific examples of the transferrer include, but are not limited to, a corona transferrer utilizing corona discharge, a transfer belt, a transfer roller, a pressure transfer roller, and an adhesive transferrer.

The recording medium is not limited to any particular material and conventional recording media (recording paper) can be used.

Fixing Process and Fixing Device

The fixing process is a process in which a visible image transferred onto the recording medium is fixed thereon by the fixing device. The fixing process may be conducted every time each color developer is transferred onto the recording medium. Alternatively, the fixing process may be conducted at once after all color developers are superimposed on one another on the recording medium.

The fixing device is not particularly limited and can be suitably selected to suit to a particular application, but preferably includes a heat-pressure member. Specific examples of the heat-pressure member include, but are not limited to, a combination of a heat roller and a pressure roller; and a combination of a heat roller, a pressure roller, and an endless belt.

The neutralization process is a process in which a neutralization bias is applied to the electrostatic latent image bearer to neutralize the electrostatic latent image bearer, and is preferably conducted by a neutralizer.

The neutralizer is not particularly limited and can be appropriately selected from known neutralizers as long as it is capable of applying a neutralization bias to the electrostatic latent image bearer. Preferred examples thereof include, but are not limited to, a neutralization lamp.

The cleaning process is a process in which residual toner particles remaining on the electrostatic latent image bearer are removed, and is preferably conducted by a cleaner.

The cleaner is not particularly limited and can be appropriately selected from known cleaners as long as it is capable of removing residual toner particles remaining on the electrostatic latent image bearer. Preferred examples thereof include, but are not limited to, magnetic brush cleaner, electrostatic brush cleaner, magnetic roller cleaner, blade cleaner, brush cleaner, and web cleaner.

The recycle process is a process in which the toner particles removed in the cleaning process are recycled for the developing device, and is preferably conducted by a recycler. The recycler is not particularly limited. Specific examples thereof include, but are not limited to, a conveyor.

The control process is a process in which the above-described processes are controlled, and is preferably conducted by a controller.

The controller is not particularly limited and can be suitably selected to suit to a particular application as long as it is capable of controlling the above-described processes. Specific examples of the controller include, but are not limited to, a sequencer and a computer.

Figure 2:
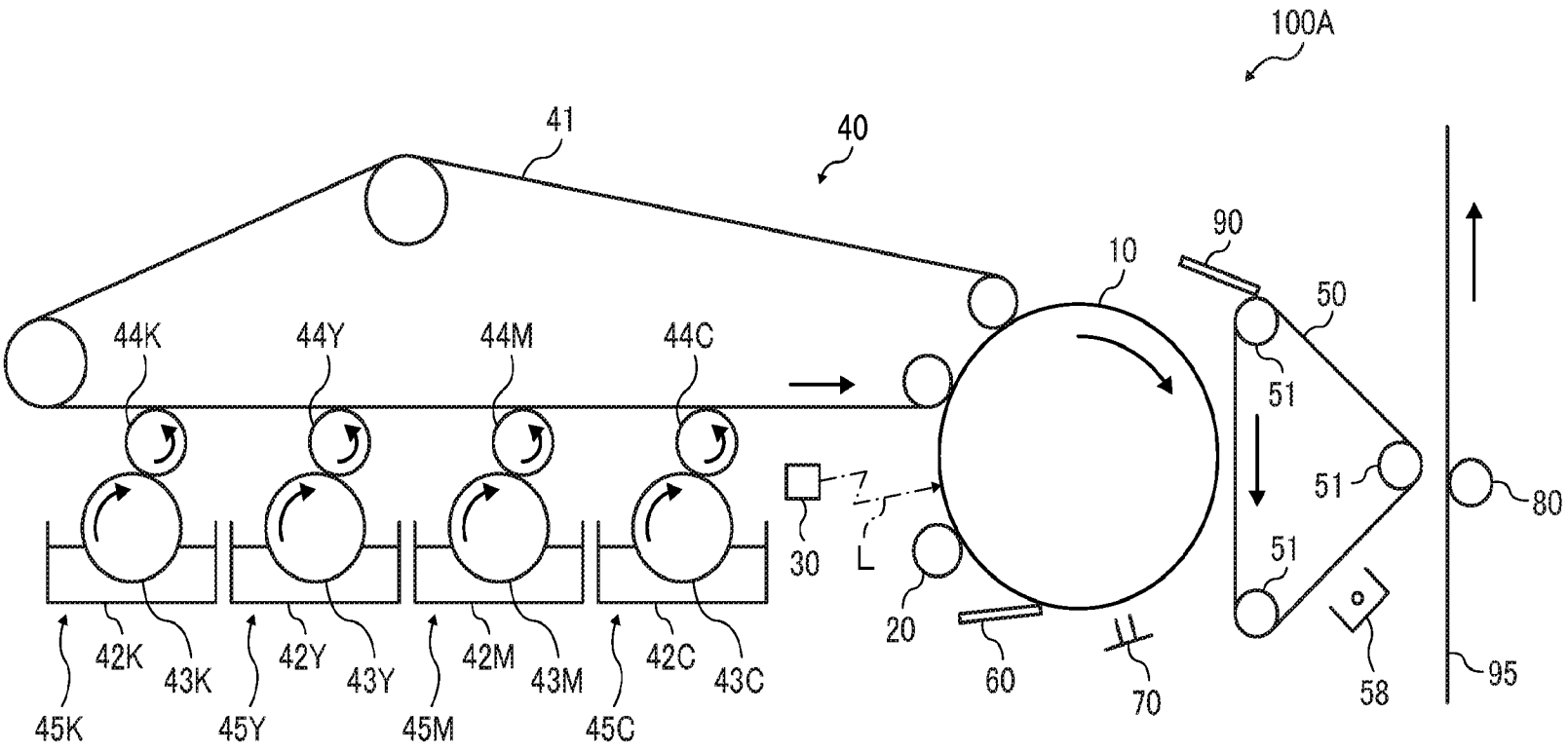
FIG. 2 is a schematic diagram illustrating an image forming apparatus according to an embodiment of the present invention.

FIG. 2 is a schematic view of a first example of the image forming apparatus according to an embodiment of the present invention.

An image forming apparatus 100A includes a photoconductor drum 10, a charging roller 20, an irradiator 30, a developing device 40, an intermediate transfer belt 50, a cleaner 60 having a cleaning blade, and a neutralization lamp 70.

The intermediate transfer belt 50 is in the form of an endless belt and is stretched taut by three rollers 51 disposed inside the loop of the endless belt. The intermediate transfer belt 50 is movable in the direction indicated by arrow in FIG. 2. One or two of the three rollers 51 also function(s) as transfer bias roller(s) capable of applying a transfer bias (primary transfer bias) to the intermediate transfer belt 50. A cleaner 90 having a cleaning blade is disposed in the vicinity of the intermediate transfer belt 50. A transfer roller 80 capable of applying a transfer bias (secondary transfer bias) to a transfer sheet 95, for transferring the toner image thereon, is disposed facing the intermediate transfer belt 50.

Around the intermediate transfer belt 50, a corona charger 58 that gives charge to the toner image transferred onto the intermediate transfer belt 50 is disposed between a contact portion of the intermediate transfer belt 50 with the photoconductor drum 10 and another contact portion of the intermediate transfer belt 50 with the transfer sheet 95 in the direction of rotation of the intermediate transfer belt 50.

The developing device 40 includes a developing belt 41, and a black developing unit 45K, a yellow developing unit 45Y, a magenta developing unit 45M, and a cyan developing unit 45C each disposed around the developing belt 41. The black, yellow, magenta, and cyan developing units 45K, 45Y, 45M, and 45C include respective developer containers 42K, 42Y, 42M, and 42C, respective developer supplying rollers 43K, 43Y, 43M, and 43C, and respective developing rollers (developer bearers) 44K, 44Y, 44M, and 44C. The developing belt 41 is in the form of an endless belt and stretched taut by multiple belt rollers. The developing belt 41 is movable in the direction indicated by arrow in FIG. 2. A part of the developing belt 41 is in contact with the photoconductor drum 10.

An image forming operation performed by the image forming apparatus 100A is described below. First, the charging roller 20 uniformly charges a surface of the photoconductor drum 10 and the irradiator 30 irradiates the surface of the photoconductor drum 10 with light L to form an electrostatic latent image. The electrostatic latent image formed on the photoconductor drum 10 is developed with toner supplied from the developing device 40 to form a toner image. The toner image formed on the photoconductor drum 10 is primarily transferred onto the intermediate transfer belt 50 by a transfer bias applied from the roller(s) 51 and then secondarily transferred onto the transfer sheet 95 by a transfer bias applied from the transfer roller 80. After the toner image has been transferred onto the intermediate transfer belt 50, the surface of the photoconductor drum 10 is cleaned by removing residual toner particles by the cleaner 60 and then neutralized by the neutralization lamp 70.

Figure 3:
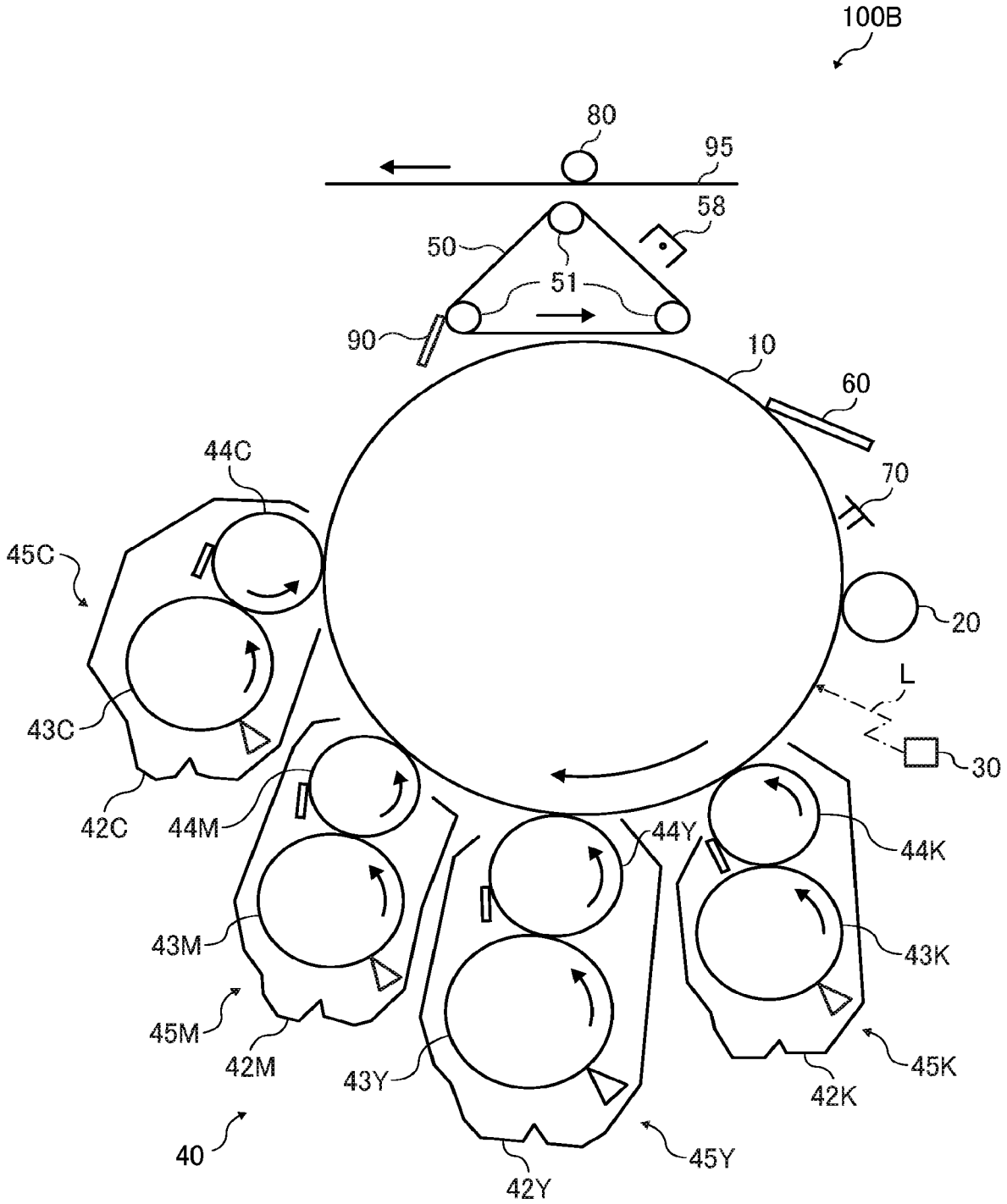
FIG. 3 is a schematic diagram illustrating an image forming apparatus according to an embodiment of the present invention.

FIG. 3 is a schematic view of a second example of the image forming apparatus according to an embodiment of the present invention. An image forming apparatus 100B has a similar configuration to the image forming apparatus 100A except that the developing belt 41 is omitted and the black developing unit 45K, the yellow developing unit 45Y, the magenta developing unit 45M, and the cyan developing unit 45C are disposed facing the circumferential surface of the photoconductor drum 10.

Figure 4:
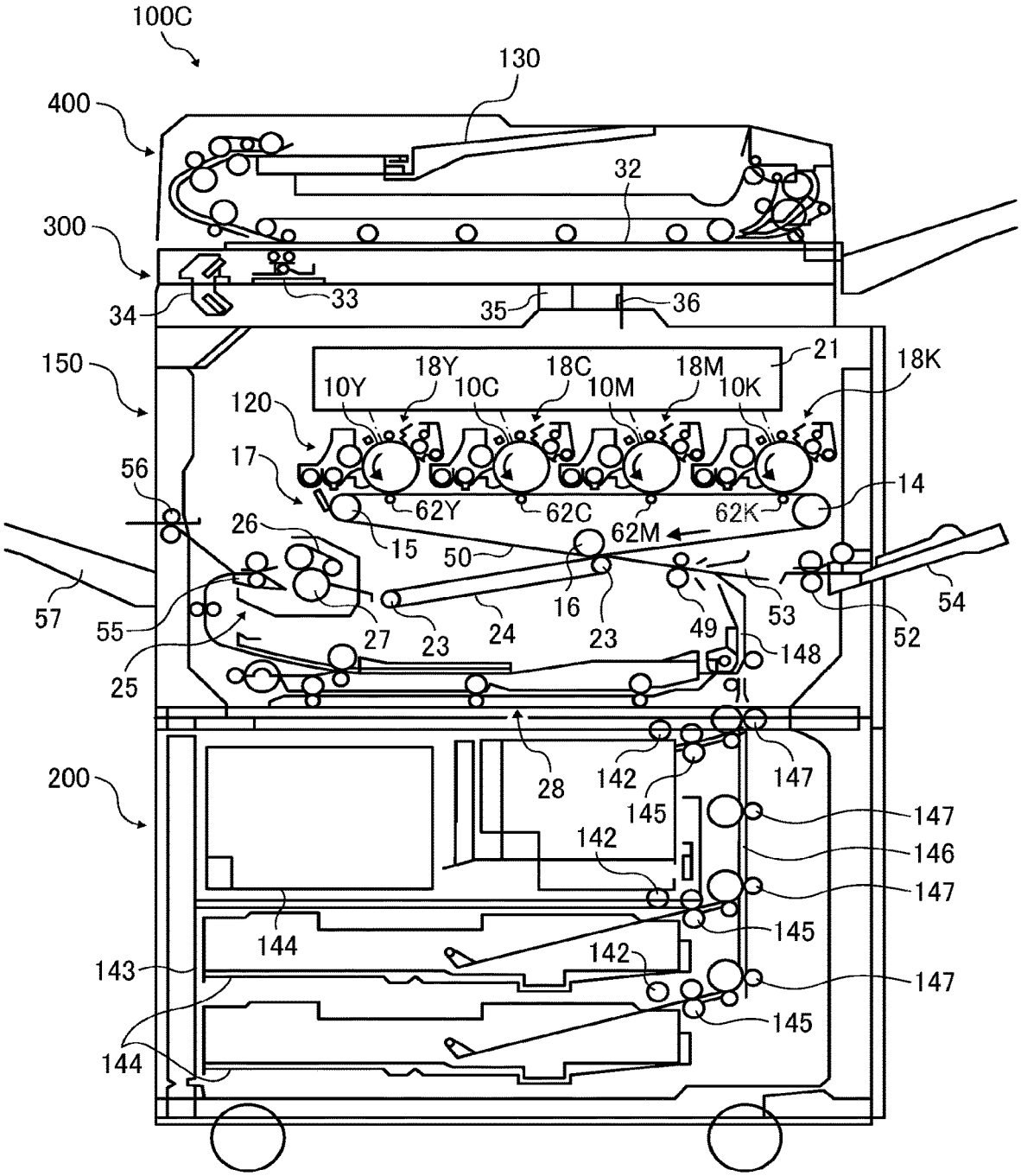
FIG. 4 is a schematic diagram illustrating an image forming apparatus according to an embodiment of the present invention.

FIG. 4 is a schematic view of a third example of the image forming apparatus according to an embodiment of the present invention. An image forming apparatus 100C is a tandem-type full-color image forming apparatus which includes a copier main body 150, a sheet feed table 200, a scanner 300, and an automatic document feeder (ADF) 400.

An intermediate transfer belt 50, disposed at the center of the copier main body 150, is in the form of an endless belt and stretched taut by three rollers 14, 15, and 16. The intermediate transfer belt 50 is movable in the direction indicated by arrow in FIG. 4. In the vicinity of the roller 15, a cleaner 17 having a cleaning blade is disposed that removes residual toner particles remaining on the intermediate transfer belt 50 from which the toner image has been transferred onto a recording sheet. Four image forming units 18Y, 18C, 18M, and 18K for respectively forming yellow, cyan, magenta, and black images are arranged in tandem along the conveyance direction and facing a part of the intermediate transfer belt 50 stretched between the support rollers 14 and 15, thus forming a tandem unit 120.

In the vicinity of the tandem unit 120, an irradiator 21 is disposed. On the opposite side of the tandem unit 120 relative to the intermediate transfer belt 50, a secondary transfer belt 24 is disposed. The secondary transfer belt 24 is in the form of an endless belt stretched taut with a pair of rollers 23. A recording sheet conveyed onto the secondary transfer belt 24 is brought into contact with the intermediate transfer belt 50 at between the rollers 16 and 23.

In the vicinity of the secondary transfer belt 24, a fixing device 25 is disposed. The fixing device 25 includes a fixing belt 26 and a pressing roller 27. The fixing belt 26 is in the form of an endless belt and stretched taut between a pair of rollers. The pressing roller 27 is pressed against the fixing belt 26. In the vicinity of the secondary transfer belt 24 and the fixing device 25, a sheet reversing device 28 is disposed for reversing the recording sheet so that images can be formed on both surfaces of the recording sheet.

A full-color image forming operation performed by the image forming apparatus 100C is described below. First, a document is set on a document table 130 of the automatic document feeder 400. Alternatively, a document is set on a contact glass 32 of the scanner 300 while the automatic document feeder 400 is lifted up, followed by holding down of the automatic document feeder 400.

As a start switch is pressed, in a case in which the document is set on the automatic document feeder 400, the scanner 300 starts driving after the document is moved onto the contact glass 32. On the other hand, in a case in which the document is set on the contact glass 32, the scanner 300 immediately starts driving. A first traveling body 33 equipped with a light source and a second traveling body 34 equipped with a mirror then start traveling. The first traveling body 33 directs light to the document and the second traveling body 34 reflects light reflected from the document toward a reading sensor 36 through an imaging lens 35. Thus, the document is read by the reading sensor 36 and converted into image information of yellow, magenta, cyan, and black.

Figure 5:
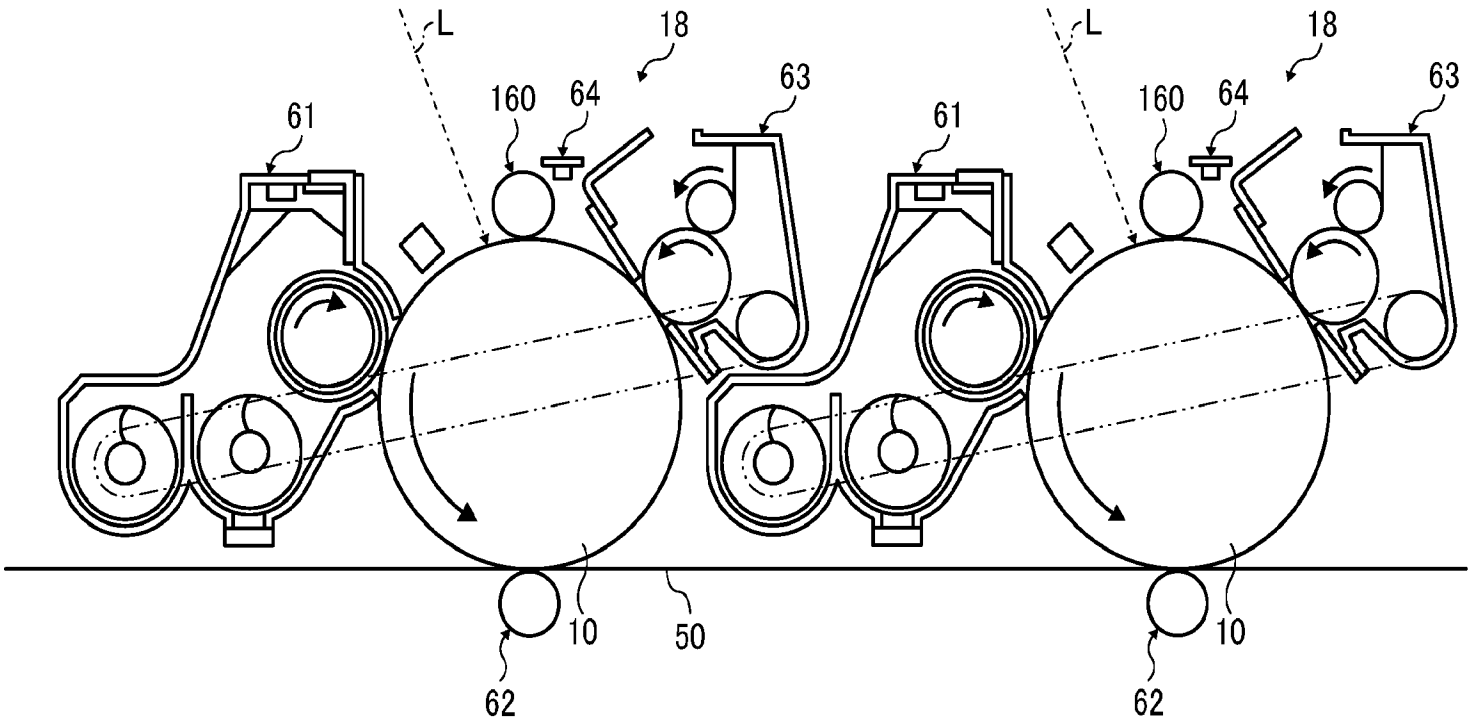
FIG. 5 is a schematic diagram illustrating an image forming unit according to an embodiment of the present invention.

The image information of each color is transmitted to the corresponding image forming unit 18Y, 18C, 18M, or 18K to form a toner image of each color. Referring to FIG. 5, each image forming unit 18 includes a photoconductor drum 10, a charging roller 160 to uniformly charge the photoconductor drum 10, a developing device 61 to develop an electrostatic latent image formed on the photoconductor drum 10 into a toner image with a developer of each color, a transfer roller 62 to transfer the toner image onto the intermediate transfer belt 50, a cleaner 63 having a cleaning blade, and a neutralization lamp 64.

The toner images formed in the image forming unit 18Y, 18C, 18M, and 18K are primarily transferred in a successive and overlapping manner onto the intermediate transfer belt 50 stretched and moved by the rollers 14, 15, and 16. Thus, a composite toner image is formed on the intermediate transfer belt 50.

At the same time, in the sheet feed table 200, one of sheet feed rollers 142 starts rotating to feed recording sheets from one of sheet feed cassettes 144 in a sheet bank 143. One of separation rollers 145 separates the recording sheets one by one and feeds them to a sheet feed path 146. Feed rollers 147 feed each sheet to a sheet feed path 148 in the copier main body 150. The sheet is stopped by striking a registration roller 49. Alternatively, recording sheets may be fed from a manual feed tray 54. In this case, a separation roller 52 separates the sheets one by one and feeds it to a manual sheet feeding path 53. The sheet is stopped upon striking the registration roller 49.

The registration roller 49 is generally grounded. Alternatively, the registration roller 49 may be applied with a bias for the purpose of removing paper powders from the sheet.

The registration roller 49 starts rotating in synchronization with an entry of the composite toner image formed on the intermediate transfer belt 50 to between the intermediate transfer belt 50 and the secondary transfer belt 24, so that the recording sheet is fed thereto and the composite toner image can be secondarily transferred onto the recording sheet. Residual toner particles remaining on the intermediate transfer belt 50 after the composite toner image has been transferred are removed by the cleaner 17.

The recording sheet having the composite toner image thereon is fed by the secondary transfer belt 24 to the fixing device 25, and the composite toner image is fixed on the recording sheet. A switch claw 55 switches sheet feed paths so that the recording sheet is ejected by an ejection roller 56 and stacked on a sheet ejection tray 57. Alternatively, the switch claw 55 may switch sheet feed paths so that the recording sheet is introduced into the sheet reversing device 28 and gets reversed. After another image is formed on the back side of the recording sheet, the recording sheet is ejected by the ejection roller 56 on the sheet ejection tray 57.

The image forming apparatus and image forming method according to some embodiments of the present invention are capable of providing high-quality images for an extended period of time because of using the toner that has excellent low-temperature fixability and heat-resistant storage stability and is unlikely to cause image fog and photoconductor filming.

EXAMPLES

Further understanding can be obtained by reference to certain specific examples which are provided herein for the purpose of illustration only and are not intended to be limiting. In the following descriptions, "parts" and "%" are based on mass unless otherwise specified.

In the Examples, "Melting Point and Glass Transition Temperature (Tg) of Resins", "Weight Average Molecular Weight (Mw) of Resins", "Thickness of Shell Layer (nm)", "Adhesion Rate (%) of Metal Oxide Directly Adhered to Surfaces of Colored Particles to All Metal Oxide Present on Colored Particles", and "Sphericity of Metal Oxide" were measured according to the procedures described below.

Measurement of Melting Point and Glass Transition Temperature (Tg) of Resins

The melting point and glass transition temperature were measured using a differential scanning calorimeter Q-200 (available from TA Instruments) in the following manner. First, about 5.0 mg of a sample was put in an aluminum sample container. The sample container was put on a holder unit and set in an electric furnace. Next, the temperature was raised from −80 degrees C. to 150 degrees C. at a temperature rising rate of 10 degrees C./min under nitrogen gas atmosphere.

The resulted DSC curve was analyzed with an analysis program installed in the differential scanning calorimeter to determine the glass transition temperature (Tg) of the sample.

The resulted DSC curve was further analyzed with an analysis program installed in the differential scanning calorimeter to determine the endothermic peak-top temperature as the melting point of the sample.

Measurement of Weight Average Molecular Weight (Mw) of Resins

The weight average molecular weight was measured using a GPC (gel permeation chromatography) instrument HLC-8220GPC (manufactured by Tosoh Corporation) equipped with triple columns TSKgel SuperHZM-H 15 cm (manufactured by Tosoh Corporation) in the following manner.

First, the columns were stabilized in a heat chamber at 40 degrees C. Next, tetrahydrofuran (THF) was allowed to flow in the columns at a flow rate of 1 mL/min, and 50 to 200 μL of a 0.05-0.6% by mass THF solution of a sample was injected into the instrument to measure the weight average molecular weight of the sample.

The polystyrene standard samples were those having respective weight average molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ (manufactured by Pressure Chemical Co. or Tosoh Corporation). As the detector, a refractive index (RI) detector was used.

Adhesion Rate (%) of Metal Oxide Directly Adhered to Surfaces of Colored Particles to all Metal Oxide Present on Colored Particles The amount (X1) of the metal oxide directly adhered to the surfaces of the colored particles and the total amount (Y) of the metal oxide present on the colored particles were measured as described below, and the adhesion rate (%) of the metal oxide directly adhered to the surfaces of the colored particles was obtained from the formula $(X1/Y)\times100$.

Amount (X1) of Metal Oxide Directly Adhered to Surfaces of Colored Particles (1) First, 5 g of a polyoxyalkylene alkyl ether (NOIGEN ET-165, manufactured by DKS Co., Ltd.) was weighed in a 500-mL beaker. Next, 300 mL of distilled water were added thereto and sonicated for dissolution. The resulting solution was transferred to a 1,000-mL volumetric flask and distilled water was added thereto to make 1,000 mL (and allow to stand for a while if foaming occurs), followed by sonication for blending, to prepare a 0.5% by mass dispersion liquid of the polyoxyalkylene alkyl ether (NOIGEN ET-165, manufactured by DKS Co., Ltd.).

(2) Next, 3.75 g of a toner sample were dispersed in 50 mL of the 0.5% by mass dispersion liquid of the polyoxyalkylene alkyl ether (NOIGEN ET-165, manufactured by DKS Co., Ltd.) in a 110-mL vial.

(3) Using an ultrasonic homogenizer (trade name: HOMOGENIZER, model VCX750, CV33, manufactured by Sonics & Materials, Inc.), ultrasonic waves were emitted with an emission energy amount of 4.8 kJ for a certain time at a frequency of 20 kHz and an output of 80 W. The emission energy amount is calculated from the product of the output and the emission time. These treatments were carried out while appropriately cooling the toner particle dispersion liquid so that the liquid temperature thereof did not exceed 40 degrees C.

(4) The resulted dispersion liquid was suction filtered with a filter paper (trade name: qualitative filter paper (No. 2, 110 mm), available from Advantec Toyo Kaisha, Ltd.), washed again with ion-exchange water twice, and filtered. After removing the metal oxide, the toner particles were dried.

(5) The proportion (% by mass) of the metal oxide adhered to the surfaces of the toner particles after the removal of the metal oxide was quantified by a measurement using an X-ray fluorescence analyzer (ZSX-100e, manufactured by Rigaku Corporation) and a calibration curve showing the intensity (or the difference in intensity before and after the removal of the metal oxide), thus determining the amount (X1) of the metal oxide directly adhered to the surfaces of the colored particles in the toner.

Total Amount (Y) of Metal Oxide Present on Colored Particles

The total amount (Y) of the metal oxide present on the colored particles was measured as follows.

Using an ultrasonic homogenizer, ultrasonic waves with an emission energy amount of 1,000 kJ and 1,500 kJ were emitted to the toner particles in the same manner as above. The toner particles were then subjected to the quantification of the metal oxide using an X-ray fluorescence analyzer to confirm whether there was a decrease in the amount of the metal oxide between the measurements at 1,000 kJ and 1,500 kJ.

When there was no decrease, it was confirmed that all the metal oxide had been desorbed from the toner particles. It is also possible to confirm that all the metal oxide has been desorbed by observing the surfaces of the toner particles using a field emission scanning electron microscope (FE-SEM) after the treatment.

When there was a change observed, the emission energy amount was further increased by 500 kJ and the same treatment was performed.

From the difference between the amount of metal oxide present on the surfaces of the toner particles from which all the metal oxide had been desorbed in the above-described manner and the amount of metal oxide present on the surfaces of the untreated toner particles from which the metal oxide had not been desorbed, the total amount (Y) of the metal oxide present on the colored particles of the toner was calculated.

Sphericity of Metal Oxide

The sphericity of the metal oxide was determined by observing primary particles of the metal oxide being dispersed in the toner particles with a scanning electron microscope (SEM) and analyzing an image of the primary particles of the metal oxide. The image analysis was performed as follows using an image analysis software program LMeye for OPTELICS C130 manufactured by Lasertec Corporation.

(1) Capture an image observed at 5.0 kV using the SEM.
(2) Adjust the calibration (scale).
(3) Perform automatic contrast.
(4) Invert.
(5) Perform edge extraction (Sobel).
(6) Perform edge extraction (Sobel) again.
(7) Perform binarization processing (discriminant analysis mode).
(8) Calculate shape features (sphericity, absolute maximum length, diagonal width) by measurement.

The sphericity of the metal oxide is 50% sphericity in the cumulative frequency of the equivalent circle diameters of 100 primary particles of the metal oxide obtained by the image analysis.

Example 1

Preparation of Toner 1

Synthesis of Ketimine 1

In a reaction vessel equipped with a stirrer and a thermometer, 170 parts of isophoronediamine and 75 parts of methyl ethyl ketone were allowed to react at 50 degrees C. for 5 hours. Thus, a ketimine compound 1 was prepared. The resulted ketimine 1 was found to have an amine value of 418 mgKOH/g.

Synthesis of Non-Crystalline Polyester Prepolymer A

A reaction vessel equipped with a condenser tube, a stirrer, and a nitrogen introducing tube was charged with 3-methyl-1,5-pentanediol, adipic acid, and trimellitic anhydride. The molar ratio of hydroxyl groups to carboxyl groups was 1.5. The proportion of trimellitic anhydride in all the monomers was 1% by mol. Furthermore, 1,000 ppm (based on all the monomers) of titanium tetraisopropoxide was added to the vessel.

Next, the temperature was raised to 200 degrees C. over a period of about 4 hours and thereafter to 230 degrees C. over a period of 2 hours. The reaction was continued until water did not flow out, then further continued for 5 hours under reduced pressures of from 10 to 15 mmHg. Thus, a non-crystalline polyester A having hydroxyl groups was prepared.

A reaction vessel equipped with a condenser tube, a stirrer, and a nitrogen introducing tube was charged with the non-crystalline polyester A having hydroxyl groups and isophorone diisocyanate. The molar ratio of isocyanate groups to hydroxyl groups was 2.0. After a dilution with ethyl acetate, a reaction was performed at 100 degrees C. for 5 hours. Thus, a 50% by mass ethyl acetate solution of the non-crystalline polyester prepolymer A was prepared.

In a reaction vessel equipped with a heater, a stirrer, and a nitrogen introducing tube, the 50% by mass ethyl acetate solution of the non-crystalline polyester prepolymer A was put and stirred, and the ketimine 1 was dropped therein. The molar ratio of amino groups to isocyanate groups was 1. Next, a stirring was performed at 45 degrees C. for 10 hours, then a vacuum drying was performed at 50 degrees C. until the remaining amount of ethyl acetate became 100 ppm or less. Thus, a non-crystalline polyester A was prepared.

The resulted non-crystalline polyester A was found to have a glass transition temperature (Tg) of −55 degrees C. and a weight average molecular weight (Mw) of 130,000.

Synthesis of Non-Crystalline Polyester B

A reaction vessel equipped with a nitrogen introducing tube, a dewatering tube, a stirrer, and a thermocouple was charged with ethylene oxide 2-mol adduct of bisphenol A (hereinafter "BisA-EO"), propylene oxide 3-mol adduct of bisphenol A (hereinafter "BisA-PO"), terephthalic acid, and adipic acid. The molar ratio of BisA-EO to BisA-PO was 40/60, the molar ratio of terephthalic acid to adipic acid was 93/7, and the molar ratio of hydroxyl groups to carboxyl groups was 1.2. Furthermore, 500 ppm (based on all the monomers) of titanium tetraisopropoxide was added to the vessel.

Next, a reaction was performed at 230 degrees C. for 8 hours and subsequently under reduced pressures of from 10 to 15 mmHg for 4 hours. After adding 1% by mol (based on all the monomers) of trimellitic anhydride to the vessel, a reaction was performed at 180 degrees C. for 3 hours. Thus, a non-crystalline polyester B was prepared. The resulted non-crystalline polyester B was found to have a glass transition temperature (Tg) of 67 degrees C. and a weight average molecular weight (Mw) of 10,000.

Synthesis of Crystalline Polyester C

A reaction vessel equipped with a nitrogen introducing tube, a dewatering tube, a stirrer, and a thermocouple was charged with sebacic acid and 1,6-hexanediol. The molar ratio of hydroxyl groups to carboxyl groups was 0.9. Furthermore, 500 ppm (based on all the monomers) of titanium tetraisopropoxide was added to the vessel.

Next, a reaction was performed at 180 degrees C. for 10 hours and subsequently at 200 degrees C. for 3 hours. The reaction was further continued under a reduced pressure of 8.3 kPa for 2 hours. Thus, a crystalline polyester C was prepared. The resulted crystalline polyester C was found to have a melting point of 67 degrees C. and a weight average molecular weight (Mw) of 25,000.

Preparation of Master Batch 1

First, 1,200 parts by mass of water, 500 parts by mass of a carbon black (PRINTEX 35 manufactured by Degussa AG, having a DBP oil absorption of 42 mL/100 mg and a pH of 9.5), and 500 parts of the non-crystalline polyester B were mixed using a HENSCHEL MIXER (manufactured by NIPPON COKE & ENGINEERING CO., LTD.). The resulted mixture was kneaded with a double roll at 150 degrees C. for 30 minutes, then rolled to cool, and pulverized with a pulverizer. Thus, a master batch 1 was prepared.

Synthesis of Wax Dispersing Agent 1

In an autoclave equipped with a thermometer and a stirrer, 100 parts by mass of a polyethylene wax SANWAX 151P (manufactured by Sanyo Chemical Industries, Ltd., having a melting point of 108 degrees C. and a weight average molecular weight (Mw) of 1,000) was dissolved in 480 parts by mass of xylene. The air in the autoclave was replaced with nitrogen gas.

Next, a mixture liquid of 805 parts by mass of styrene, 50 parts by mass of acrylonitrile, 45 parts by mass of butyl acrylate, 36 parts by mass of di-t-butyl peroxide, and 100 parts by mass of xylene was dropped in the vessel over a period of 3 hours to perform a polymerization at 170 degrees C. for 30 minutes. The solvent was thereafter removed. Thus, a wax dispersing agent 1 was prepared. The resulted wax dispersing agent 1 was found to have a glass transition temperature of 65 degrees C. and a weight average molecular weight (Mw) of 18,000.

Preparation of Wax Dispersion Liquid 1

A vessel equipped with a stirrer and a thermometer was charged with 300 parts by mass of a paraffin wax (HNP-9 manufactured by NIPPON SEIRO CO., LTD., having a melting point of 75 degrees C.), 150 parts of the wax dispersing agent 1, and 1,800 parts of ethyl acetate.

Next, under stirring, the temperature was held at 80 degrees C. for 5 hours and then reduced to 30 degrees C. over a period of 1 hour. Next, a dispersion treatment using a bead mill (ULTRAVISCOMILL manufactured by AIMEX CO., LTD.) filled with 80% by volume of zirconia beads having a diameter of 0.5 mm was performed 3 times. Thus, a wax dispersion liquid 1 was prepared. In the dispersion treatment, the liquid feeding speed was 1 kg/hour and the disc peripheral speed was 6 m/sec.

Preparation of Crystalline Polyester Dispersion Liquid 1

A vessel equipped with a stirrer and a thermometer was charged with 308 parts by mass of the crystalline polyester C and 1,900 parts by mass of ethyl acetate. Next, under stirring, the temperature was held at 80 degrees C. for 5 hours and then reduced to 30 degrees C. over a period of 1 hour. Next, a dispersion treatment using a bead mill (ULTRAVISCOMILL manufactured by AIMEX CO., LTD.) filled with 80% by volume of zirconia beads having a diameter of 0.5 mm was performed 3 times. Thus, a crystalline polyester dispersion liquid 1 was prepared. In the dispersion treatment, the liquid feeding speed was 1 kg/hour and the disc peripheral speed was 6 m/sec.

Preparation of Oil Phase 1

In a vessel, 225 parts by mass of the wax dispersion liquid 1, 40 parts by mass of the 50% by mass ethyl acetate solution of the non-crystalline polyester prepolymer A, 390 parts by mass of the non-crystalline polyester B, 225 parts by mass of the crystalline polyester dispersion liquid 1, 60 parts by mass of the master batch 1, and 285 parts by mass of ethyl acetate were mixed using a TK HOMOMIXER (manufactured by PRIMIX Corporation) at a revolution of 7,000 rpm for 60 minutes. Thus, an oil phase 1 was prepared.

Synthesis of Vinyl Resin Dispersion Liquid 1

In a reaction vessel equipped with a stirrer and a thermometer, 683 parts by mass of water, 11 parts by mass of a sodium salt of a sulfate of ethylene oxide adduct of methacrylic acid (ELEMINOL RS-30 manufactured by Sanyo Chemical Industries, Ltd.), 138 parts by mass of styrene, 138 parts by mass of methacrylic acid, and 1 part by mass of ammonium persulfate were stirred at 400 rpm for 15 minutes. Thus, a white emulsion was prepared.

Next, the temperature of the reaction system was raised to 75 degrees C., and a reaction was performed for 5 hours. After that, 30 parts by mass of a 1% by mass aqueous solution of ammonium persulfate were added to the vessel, and an aging was performed at 75 degrees for 5 hours. Thus, a vinyl resin dispersion liquid 1 was prepared. The vinyl resin dispersion liquid 1 was found to have a volume average particle diameter of 0.14 μm.

The volume average particle diameter of the vinyl resin dispersion liquid 1 was measured using a laser diffraction particle size distribution analyzer (LA-920 manufactured by HORIBA, Ltd.).

Preparation of Aqueous Phase 1

An aqueous phase 1 was prepared by stir-mixing 990 parts by mass of water, 83 parts by mass of the vinyl resin dispersion liquid 1, 37 parts by mass of a 48.5% by mass aqueous solution of dodecyl diphenyl ether sodium disulfonate (ELEMINOL MON-7 manufactured by Sanyo Chemical Industries, Ltd.), and 90 parts by mass of ethyl acetate. The aqueous phase 1 was milky white.

Preparation of Shell Resin

Production of Resin Dispersion 1 (Styrene-Acrylic Resin)

In a reaction vessel equipped with a condenser tube, a stirrer, and a nitrogen introducing tube, 1.0 part of sodium dodecyl sulfate was dissolved in 498 parts of ion-exchange water under stirring and heating at 80 degrees C. After that, a solution in which 2.6 parts of potassium persulfate were dissolved in 104 parts of ion-exchange water was added to the vessel, and 15 minutes later, a monomer mixture liquid containing 170 parts of styrene monomer, 30 parts of butyl acrylate, and 4.2 parts of n-octanethiol was dropped therein over a period of 90 minutes. The temperature was kept at 80 degrees C. for 60 minutes to perform a polymerization reaction.

The vessel was then cooled to obtain a white resin dispersion 1 having a volume average particle diameter of 49 nm.

Production of Resin Dispersion 2 (Styrene-Acrylic Resin)

In a reaction vessel equipped with a condenser tube, a stirrer, and a nitrogen introducing tube, 3.5 parts of sodium dodecyl sulfate was dissolved in 498 parts of ion-exchange water under stirring and heating at 80 degrees C. After that, a solution in which 2.6 parts of potassium persulfate were dissolved in 104 parts of ion-exchange water was added to the vessel, and 15 minutes later, a monomer mixture liquid containing 170 parts of styrene monomer, 30 parts of butyl acrylate, and 4.2 parts of n-octanethiol was dropped therein over a period of 90 minutes. The temperature was kept at 80 degrees C. for 60 minutes to perform a polymerization reaction.

The vessel was then cooled to obtain a white resin dispersion 2 having a volume average particle diameter of 28 nm.

Production of Resin Dispersion 3 (Styrene-Acrylic Resin)

In a reaction vessel equipped with a condenser tube, a stirrer, and a nitrogen introducing tube, 0.7 parts of sodium dodecyl sulfate was dissolved in 498 parts of ion-exchange water under stirring and heating at 80 degrees C. After that, a solution in which 2.6 parts of potassium persulfate were dissolved in 104 parts of ion-exchange water was added to the vessel, and 15 minutes later, a monomer mixture liquid containing 170 parts of styrene monomer, 30 parts of butyl acrylate, and 4.2 parts of n-octanethiol was dropped therein over a period of 90 minutes. The temperature was kept at 80 degrees C. for 60 minutes to perform a polymerization reaction. The vessel was then cooled to obtain a white resin dispersion 3 having a volume average particle diameter of 81 nm.

Production of Resin Dispersion 4 (Styrene-Acrylic Resin)

In a reaction vessel equipped with a condenser tube, a stirrer, and a nitrogen introducing tube, 0.5 parts of sodium dodecyl sulfate was dissolved in 498 parts of ion-exchange water under stirring and heating at 80 degrees C. After that, a solution in which 2.6 parts of potassium persulfate were dissolved in 104 parts of ion-exchange water was added to the vessel, and 15 minutes later, a monomer mixture liquid containing 170 parts of styrene monomer, 30 parts of butyl acrylate, and 4.2 parts of n-octanethiol was dropped therein over a period of 90 minutes. The temperature was kept at 80 degrees C. for 60 minutes to perform a polymerization reaction.

The vessel was then cooled to obtain a white resin dispersion 4 having a volume average particle diameter of 105 nm.

Production of Resin Dispersion 5 (Acrylic Resin)

In a one-liter four-necked flask equipped with an introducing tube, 400 parts of ion-exchange water and 12 parts of dodecylbenzenesulfonate ammonium salt were put. After the temperature was raised to 85 degrees C., 0.5 parts by mass of ammonium peroxodisulfate (APS) were further put therein.

Next, while maintaining the temperature at 76 to 78 degrees C., an aqueous emulsion containing 75 parts of methyl methacrylate (MMA), 25 parts of ethylene glycol dimethacrylate, 5 parts of ethylene glycol monostearate having an HLB (hydrophilic-lipophilic balance) of 2, 1 part of dodecylbenzenesulfonate ammonium salt, and 40 parts of ion-exchange water was dropped therein to perform a polymerization.

After holding for 30 minutes, the temperature was raised to 85 degrees C. and held for 1.5 hours.

The vessel was then cooled to obtain a white resin dispersion 5 having a volume average particle diameter of 40 nm.

Emulsification and Solvent Removal

In the vessel containing the oil phase 1, 0.2 parts by mass of the ketimine 1 and 1,200 parts by mass of the aqueous phase 1 were put and mixed using a TK HOMOMIXER (manufactured by PRIMIX Corporation) at a revolution of 13,000 rpm for 20 minutes. Thus, an emulsion slurry 1 was prepared.

A mixture of 2.5 parts of the resin dispersion 1 and 2.5 parts of the resin dispersion 5 was dropped in the emulsion slurry 1 being mixed using the TK HOMOMIXER adjusted to a revolution of 300 to 500 rpm. Ten minutes later of the dropping, the mixture was diluted 1.4 times with ion-exchange water, thus obtaining a mixed liquid 1.

The mixed liquid 1 was put in a vessel equipped with a stirrer and a thermometer and subjected to solvent removal at 30 degrees C. for 8 hours and subsequently to an aging at 45 degrees C. for 4 hours. Thus, a dispersion slurry 1 was prepared.

Washing, Heating, and Drying

First, 100 parts by mass of the dispersion slurry 1 were filtered under reduced pressures. Next, 100 parts by mass of ion-exchange water were added to the filter cake and mixed therewith using a TK HOMOMIXER (manufactured by PRIMIX Corporation) at a revolution of 12,000 rpm for 10 minutes, followed by filtration. (This process is hereinafter referred to as "washing process (1)"). Further, 100 parts by mass of a 10% by mass aqueous solution of sodium hydroxide were added to the filter cake and mixed therewith using the TK HOMOMIXER at a revolution of 12,000 rpm for 30 minutes, followed by filtration under reduced pressures. (This process is hereinafter referred to as "washing process (2)"). Next, 100 parts by mass of a 10% aqueous solution of hydrochloric acid were added to the filter cake and mixed therewith using the TK HOMOMIXER at a revolution of 12,000 rpm for 10 minutes, followed by filtration. (This process is hereinafter referred to as "washing process (3)"). Further, 300 parts by mass of ion-exchange water were added to the filter cake and mixed therewith using the TK HOMOMIXER at a revolution of 12,000 rpm for 10 minutes, followed by filtration. (This process is hereinafter referred to as "washing process (4)"). The series of washing processes (1) to (4) was repeated twice.

Further, 100 parts of ion-exchange water were added to the filter cake and mixed therewith using the TK HOMOMIXER at a revolution of 12,000 rpm for 10 minutes. The filter cake was then heated at 50 degrees C. for 4 hours, followed by filtration.

The filter cake was dried by a circulating air dryer at 45 degrees C. for 48 hours and sieved with a mesh having an opening of 75 μm. Thus, colored particles 1 were prepared. The thickness of the shell layer was 70 nm.

External Additive Mixing Process

First, 100 parts by mass of the colored particles 1 and 0.5 parts by mass of an alumina (AEROXIDE Alu65 manufactured by Nippon Aerosil Co., Ltd., having a sphericity of 0.7) were put in a 20-L HENSCHEL MIXER (manufactured by NIPPON COKE & ENGINEERING CO., LTD.) and mixed at a peripheral speed of 40 m/s for 3 minutes. After that, 2 parts by mass of a silica (AEROSIL NX90G manufactured by Nippon Aerosil Co., Ltd.) were added thereto and mixed at a peripheral speed of 40 m/s for 22 minutes. The resulted mixture was allowed to pass through a 500-mesh sieve. Thus, a toner 1 was prepared.

Example 2

Preparation of Toner 2

A toner 2 was prepared in the same manner as in Example 1 except for replacing the aluminum oxide as the metal oxide with a cerium oxide (having a sphericity of 0.7).

Example 3

Preparation of Toner 3

A toner 3 was prepared in the same manner as in Example 1 except for replacing the aluminum oxide as the metal oxide with a zinc oxide (having a sphericity of 0.7).

Example 4

Preparation of Toner 4

A toner 4 was prepared in the same manner as in Example 1 except for changing the addition amount of the aluminum oxide as the metal oxide from 0.5 parts by mass to 0.1 parts by mass.

Example 5

Preparation of Toner 5

A toner 5 was prepared in the same manner as in Example 1 except for changing the addition amount of the aluminum oxide as the metal oxide from 0.5 parts by mass to 0.3 parts by mass.

Example 6

Preparation of Toner 6

A toner 6 was prepared in the same manner as in Example 1 except for changing the addition amount of the aluminum oxide as the metal oxide from 0.5 parts by mass to 0.9 parts by mass.

Example 7

Preparation of Toner 7

A toner 7 was prepared in the same manner as in Example 1 except for changing the addition amount of the aluminum oxide as the metal oxide from 0.5 parts by mass to 1.1 parts by mass.

Example 8

Preparation of Toner 8

The procedure for preparing the colored particles 1 in Example 1 was repeated except for replacing 2.5 parts of the resin dispersion 1 with 1.5 parts of the resin dispersion 1 in the process of "Emulsification and Solvent Removal". Thus, colored particles 2 were prepared. The thickness of the shell layer was 51 nm.

A toner 8 was prepared in the same manner as in Example 1 except for replacing the colored particles 1 with the colored particles 2.

Example 9

Preparation of Toner 9

The procedure for preparing the colored particles 1 in Example 1 was repeated except for replacing 2.5 parts of the resin dispersion 1 with 4.5 parts of the resin dispersion 1 in the process of "Emulsification and Solvent Removal". Thus, colored particles 3 were prepared. The thickness of the shell layer was 128 nm.

A toner 9 was prepared in the same manner as in Example 1 except for replacing the colored particles 1 with the colored particles 3.

Example 10

Preparation of Toner 10

The procedure for preparing the colored particles 1 in Example 1 was repeated except for replacing 2.5 parts of the resin dispersion 1 with 1.5 parts of the resin dispersion 2 in the process of "Emulsification and Solvent Removal". Thus, colored particles 4 were prepared. The thickness of the shell layer was 31 nm.

A toner 10 was prepared in the same manner as in Example 1 except for replacing the colored particles 1 with the colored particles 4.

Example 11

Preparation of Toner 11

The procedure for preparing the colored particles 1 in Example 1 was repeated except for replacing 2.5 parts of the resin dispersion 1 with 2.5 parts of the resin dispersion 3 in the process of "Emulsification and Solvent Removal". Thus, colored particles 5 were prepared. The thickness of the shell layer was 100 nm.

A toner 11 was prepared in the same manner as in Example 1 except for replacing the colored particles 1 with the colored particles 5.

Example 12

Preparation of Toner 12

The procedure for preparing the colored particles 1 in Example 1 was repeated except for replacing 2.5 parts of the resin dispersion 1 with 2.5 parts of the resin dispersion 4 in the process of "Emulsification and Solvent Removal". Thus, colored particles 6 were prepared. The thickness of the shell layer was 130 nm.

A toner 12 was prepared in the same manner as in Example 1 except for replacing the colored particles 1 with the colored particles 6.

Example 13

Preparation of Toner 13

A toner 13 was prepared in the same manner as in Example 1 except for replacing the aluminum oxide as the metal oxide with a zirconium oxide (having a sphericity of 0.8).

Example 14

Preparation of Toner 14

A toner 14 was prepared in the same manner as in Example 1 except for changing the "External Additive Mixing Process" as follows.

External Additive Mixing Process

First, 100 parts by mass of the colored particles 1, 0.5 parts by mass of an alumina (AEROXIDE Alu65 manufactured by Nippon Aerosil Co., Ltd., having a sphericity of 0.7), and 2 parts by mass of a silica (AEROSIL NX90G manufactured by Nippon Aerosil Co., Ltd.) were put in a 20-L HENSCHEL MIXER (manufactured by NIPPON COKE & ENGINEERING CO., LTD.) and mixed at a peripheral speed of 40 m/s for 25 minutes. After that, the resulted mixture was allowed to pass through a 500-mesh sieve.

Example 15

Preparation of Toner 15

A toner 15 was prepared in the same manner as in Example 1 except for changing the "External Additive Mixing Process" as follows. External Additive Mixing Process First, 100 parts by mass of the colored particles 1 and 2 parts by mass of a silica (AEROSIL NX90G manufactured by Nippon Aerosil Co., Ltd.) were put in a 20-L HENSCHEL MIXER (manufactured by NIPPON COKE & ENGINEERING CO., LTD.) and mixed at a peripheral speed of 40 m/s for 3 minutes. After that, 0.5 parts by mass of an alumina (AEROXIDE Alu65 manufactured by Nippon Aerosil Co., Ltd., having a sphericity of 0.7) were added thereto and mixed at a peripheral speed of 40 m/s for 22 minutes. The resulted mixture was allowed to pass through a 500-mesh sieve.

Comparative Example 1

Preparation of Toner 16

The procedure for preparing the colored particles 1 in Example 1 was repeated except for replacing 2.5 parts of the resin dispersion 1 with 7.0 parts of the resin dispersion 3 in the process of "Emulsification and Solvent Removal". Thus, colored particles 7 were prepared. The thickness of the shell layer was 145 nm.

A toner 16 was prepared in the same manner as in Example 1 except for replacing the colored particles 1 with the colored particles 7.

Comparative Example 2

Preparation of Toner 17

A toner 17 was prepared in the same manner as in Example 1 except for replacing the aluminum oxide as the metal oxide with a titanium oxide.

Comparative Example 3

Preparation of Toner 18

A toner 18 was prepared in the same manner as in Example 1 except for replacing the aluminum oxide as the metal oxide with 0.8 parts by mass of a titanium oxide.

Comparative Example 4

Preparation of Toner 19

A toner 19 was prepared in the same manner as in Example 1 except for replacing the aluminum oxide as the metal oxide with a magnesium oxide.

Comparative Example 5

Preparation of Toner 20

The procedure for preparing the colored particles 1 in Example 1 was repeated that 2.5 parts of the resin dispersion 1 were not added in the process of "Emulsification and Solvent Removal". Thus, colored particles 8 were prepared. A toner 20 was prepared in the same manner as in Example 1 except for replacing the colored particles 1 with the colored particles 8.

Comparative Example 6

Preparation of Toner 21

The procedure for preparing the colored particles 1 in Example 1 was repeated except for replacing 2.5 parts of the resin dispersion 1 with 8.0 parts of the resin dispersion 1 in the process of "Emulsification and Solvent Removal". Thus, colored particles 9 were prepared. The thickness of the shell layer was 155 nm.

A toner 21 was prepared in the same manner as in Example 1 except for replacing the colored particles 1 with the colored particles 9.

Comparative Example 7

Preparation of Toner 22

The procedure for preparing the colored particles 1 in Example 1 was repeated except for replacing 2.5 parts of the resin dispersion 1 with 0.5 parts of the resin dispersion 1 in the process of "Emulsification and Solvent Removal". Thus, colored particles 10 were prepared. The thickness of the shell layer was 28 nm.

A toner 22 was prepared in the same manner as in Example 1 except for replacing the colored particles 1 with the colored particles 10.

Production of Carrier

Preparation of Coating Film Forming Liquid

The following composition was dispersed by a homomixer for 10 minutes to prepare a coating film forming liquid containing a silicone resin.

[Composition]

Silicone resin solution (SR2410 manufactured by Dow Corning Toray Silicone Co., Ltd., having a solid content of 23% by mass): 132.2 parts by mass Aminosilane (SH6020 manufactured by Dow Corning Toray Silicone Co., Ltd., having a solid content of 100% by mass): 0.66 parts by mass Conductive particles (base is alumina, the lower layer surface-treated with tin dioxide, the upper layer surface-treated with indium oxide containing tin dioxide, the particle diameter is 0.35 μm, the powder resistivity is 3.5 Ω·cm): 31 parts by mass Toluene: 300 parts by mass Preparation of Carrier A calcined ferrite powder having a volume average particle diameter of 70 μm was used as a core material. The coating film forming liquid 1 was applied to the surface of the core material using a SPIRA COTA (manufactured by Okada Seiko Co., Ltd.) at an inner temperature of 40 degrees C., followed by drying, to form a coating film having a film thickness of 0.15 μm.

The core material having the coating film thereon was burnt in an electric furnace at 300 degrees C. for 1 hour. After being cooled, the ferrite powder bulk was pulverized with a sieve having an opening of 125 μm. Thus, a carrier was prepared.

Preparation of Developer

Each of the toners prepared in Examples 1 to 15 and Comparative Examples 1 to 7 in an amount of 8% by mass was uniformly mixed with the carrier in an amount of 92% by mass to prepare each two-component developer.

Images were formed with the developers, and various properties were evaluated as follows. The results are presented in Tables 1-1 to 1-5.

Image Formation

Images were formed under the following conditions using an image forming apparatus (RICOH PRO C751ex manufactured by Ricoh Co., Ltd.) which had been modified to make the charger, the process linear velocity, and the developing gap of the developing device variable.

Unless otherwise specified, the process linear velocity was set to 500 mm/s, the charger was a contact charger, and the developing gap of the developing device was set to 0.3 mm.

An image with an image area ratio of 5% and an image with an image area ratio of 20% were alternately output on every 1,000 sheets. The 0th to less than 10,000th sheets were output at 23 degrees C. and 50% RH, the 10,000th sheets to less than 20,000th sheets were output at 28 degrees C. and 85% RH, and the 20,000th sheets to less than the 30,000th sheets were output at 15 degrees C. and 30% RH. This image formation procedure by the actual machine was carried out 3 times to output 90,000 sheets in total.

Low-temperature Fixability

The temperature condition was set to 115 degrees C. A dot image and a solid image were alternately output every 10,000 sheets. Whether image peeling had occurred or not was judged. The image density of the solid image was measured using X-Rite 938 (manufactured by X-Rite Inc.) before and after the solid image had been rubbed with a pad, to determine the residual rate of image density. Low-temperature fixability was evaluated according to the following criteria. The ranks A+, A, and B are acceptable in practical use.

Evaluation Criteria

A+: No image peeling occurred, and the residual rate of image density is 90% or more.

A: No image peeling occurred, and the residual rate of image density is 75% or more and less than 90%.

B: No image peeling occurred, and the residual rate of image density is 60% or more and less than 75%.

C: Image peeling occurred, or the residual rate of image density is less than 60%.

Heat-Resistant Storage Stability

Each toner was stored at 50 degrees C. for 8 hours and thereafter sieved with a 42-mesh for 2 minutes. The residual rate of toner particles remaining on the mesh was measured. The smaller the residual rate, the better the heat-resistant storage stability of toner.

Heat-resistant storage stability was evaluated based on the following criteria. The ranks A+, A, and B are acceptable in practical use.

Evaluation Criteria

A: The residual rate is lower than 5%.

B: The residual rate is 5% or higher and lower than 15%.

C: The residual rate is 15% or higher and lower than 30%.

D: The residual rate is 30% or higher.

Image Fog

After the image formation on 90,000 sheets had been completed, the toner was forcibly supplied, and a white solid image was output. The image was evaluated based on the number and size of black spots generated in the background portion. The degree of image fog was evaluated according to the following evaluation criteria. The ranks A+, A, and B are acceptable in practical use.

Evaluation Criteria

A+: No black spot is generated in the background portion. Very good.

A: The number of black spots generated in the background portion is 1 or more and less than 5, and the size of the black spots is less than 2 mm. Good.

B: The number of black spots generated in the background portion is 5 or more and less than 10, and the size of the black spots is 2 mm or more and less than 3 mm. Slightly poor.

C: The number of black spots generated in the background portion is 10 or more, and the size of the black spots is 3 mm or more. Very poor.

Photoconductor Filming

After the image formation on 90,000 sheets had been completed, the photoconductor was observed, and whether abnormal images were generated or not in solid images was confirmed. The degree of photoconductor filming was evaluated according to the following criteria. The ranks A+, A, and B are acceptable in practical use.

The photoconductor filming here refers to a phenomenon in which the colored particles and the external additive are fixedly adhered to the photoconductor due to the pressure from the cleaning blade or the like and unable to develop images.

Evaluation Criteria

A: No toner is adhered to the photoconductor.

B: Toner is slightly adhered to the photoconductor, but no white spot is detected in the solid image.

C: Toner is adhered to the photoconductor, and white spots are generated in the solid image.

Comprehensive Judgment

The evaluation criteria for comprehensive judgment are as follows. "A+" is extremely good, "A" is good, "B" is acceptable in practical use, and "D" is unacceptable in practical use. The ranks A+, A, and B are acceptable, and the rank C is unacceptable.

Evaluation Criteria

A+: Rank A+ in two or more of the above evaluations, and neither rank B nor C in the above evaluations.

A: Rank A+ in one of the above evaluations, and neither rank B nor C in the above evaluations.

B: Rank B in one or more of the above evaluations, and no rank C in the above evaluations.

C: Rank C in one or more of the above evaluations.

TABLE 1-1

| | Examples Colored Particles | Example 1 Colored particles 1 | Example 2 Colored particles 1 | Example 3 Colored particles 1 | Example 4 Colored particles 1 | Example 5 Colored particles 1 |
|---|---|---|---|---|---|---|
| Shell Layer | Addition Amount (part) | 2.5 | 2.5 | 2.5 | 2.5 | 2.5 |
| | Particle Diameter (nm) | 40 | 40 | 40 | 40 | 40 |
| | Thickness (nm) | 70 | 70 | 70 | 70 | 70 |
| Metal Oxide (A) | Type | Aluminum oxide | Cerium oxide | Zinc oxide | Aluminum oxide | Aluminum oxide |
| | Addition Amount (part) | 0.5 | 0.5 | 0.5 | 0.1 | 0.3 |
| | Sphericity | 0.7 | 0.7 | 0.7 | 0.7 | 0.7 |
| | X(A)/X(Si) | 0.6 | 0.7 | 0.5 | 0.6 | 0.6 |
| | Adhesion Rate (%) | 80 | 70 | 90 | 90 | 75 |
| External Additive Mixing | Mixing Method | Split/Pre-addition | Split/Pre-addition | Split/Pre-addition | Split/Pre-addition | Split/Pre-addition |
| Image Evaluation | Low-temperature Fixability | A+ | A+ | A+ | A+ | A+ |
| | Heat-resistant Storage Stability | A | A | A | B | A |
| | Image Fog | A | A | B | A | A |
| | Photoconductor Filming | A | A | A | B | A |
| | Comprehensive Judgment | A+ | A | B | B | A |

TABLE 1-2

| | Examples Colored Particles | Example 6 Colored particles 1 | Example 7 Colored particles 1 | Example 8 Colored particles 2 | Example 9 Colored particles 3 | Example 10 Colored particles 4 |
|---|---|---|---|---|---|---|
| Shell Layer | Addition Amount (part) | 2.5 | 2.5 | 1.5 | 4.5 | 1.5 |
| | Particle Diameter (nm) | 40 | 40 | 40 | 40 | 28 |
| | Thickness (nm) | 70 | 70 | 51 | 128 | 31 |
| Metal Oxide (A) | Type | Aluminum oxide | Aluminum oxide | Aluminum oxide | Aluminum oxide | Aluminum oxide |
| | Addition Amount (part) | 0.9 | 1.1 | 0.5 | 0.5 | 0.5 |
| | Sphericity | 0.7 | 0.7 | 0.7 | 0.7 | 0.7 |
| | X(A)/X(Si) | 0.6 | 0.6 | 0.6 | 0.6 | 0.6 |
| | Adhesion Rate (%) | 70 | 65 | 85 | 75 | 75 |
| External Additive Mixing | Mixing Method | Split/Pre-addition | Split/Pre-addition | Split/Pre-addition | Split/Pre-addition | Split/Pre-addition |
| Image Evaluation | Low-temperature Fixability | A+ | A | A+ | B | A+ |
| | Heat-resistant Storage Stability | A | A+ | B | A+ | A |
| | Image Fog | A | B | A | A | B |
| | Photoconductor Filming | A | A | A | A | B |
| | Comprehensive Judgment | A | B | B | B | B |

TABLE 1-3

| | Examples Colored Particles | Example 11 Colored particles 5 | Example 12 Colored particles 6 | Example 13 Colored particles 1 | Example 14 Colored particles 1 | Example 15 Colored particles 1 |
|---|---|---|---|---|---|---|
| Shell Layer | Addition Amount (part) | 2.5 | 2.5 | 2.5 | 2.5 | 2.5 |
| | Particle Diameter (nm) | 81 | 100 | 40 | 40 | 40 |
| | Thickness (nm) | 100 | 130 | 70 | 70 | 70 |
| Metal Oxide (A) | Type | Aluminum oxide | Aluminum oxide | Zinconium oxide | Aluminum oxide | Aluminum oxide |
| | Addition Amount (part) | 0.5 | 0.5 | 0.5 | 0.5 | 0.5 |
| | Sphericity | 0.7 | 0.7 | 0.8 | 0.7 | 0.7 |
| | X(A)/X(Si) | 0.6 | 0.6 | 0.8 | 0.6 | 0.6 |
| | Adhesion Rate (%) | 70 | 65 | 65 | 60 | 70 |
| External Additive Mixing | Mixing Method | Split/Pre-addition | Split/Pre-addition | Split/Pre-addition | Batch | Split/Post-addition |
| Image Evaluation | Low-temperature Fixability | A | B | A+ | A+ | A+ |
| | Heat-resistant Storage Stability | A | A | A | A | A |
| | Image Fog Photoconductor | A | A | A | B | A |
| | Filming | A | A | B | B | A |
| | Comprehensive Judgment | A | B | B | B | A |

| | Examples Colored Particles | Comparative Example 1 Colored particles 7 | Comparative Example 2 Colored particles 1 | Comparative Example 3 Colored particles 1 | Comparative Example 4 Colored particles 1 |
|---|---|---|---|---|---|
| Shell Layer | Addition Amount (part) | 7 | 2.5 | 2.5 | 2.5 |
| | Particle Diameter (nm) | 40 | 40 | 40 | 40 |
| | Thickness (nm) | 145 | 70 | 70 | 70 |
| Metal Oxide (A) | Type | Aluminum oxide | Titanium oxide | Titanium oxide | Magnesium oxide |
| | Addition Amount (part) | 0.5 | 0.5 | 0.8 | 0.5 |
| | Sphericity | 0.7 | 0.4 | 0.4 | 0.7 |
| | X(A)/X(Si) | 0.6 | 0.9 | 0.9 | 0.4 |
| | Adhesion Rate (%) | 70 | 70 | 55 | 90 |
| External Additive Mixing | Mixing Method | Split/Pre-addition | Split/Pre-addition | Split/Pre-addition | Split/Pre-addition |
| Image Evaluation | Low-temperature Fixability | C | A+ | A+ | A+ |
| | Heat-resistant Storage Stability | A | A | A | A |
| | Image Fog Photoconductor | A | B | B | C |
| | Filming | A | C | C | C |
| | Comprehensive Judgment | C | C | C | C |

TABLE 1-5

| Examples | | Comparative Example 5 | Comparative Example 6 | Comparative Example 7 |
|---|---|---|---|---|
| Colored Particles | | Colored particles 8 | Colored particles 9 | Colored particles 10 |
| Shell Layer | Addition Amount (part) | 0 | 8 | 0.5 |
| | Particle Diameter (nm) | — | 40 | 40 |
| | Thickness (nm) | 0 | 155 | 28 |
| Metal Oxide (A) | Type | Aluminum oxide | Aluminum oxide | Aluminum oxide |
| | Addition Amount (part) | 1.1 | 0.5 | 0.5 |
| | Sphericity | 0.7 | 0.7 | 0.7 |
| | X(A)/X(Si) | 0.6 | 0.6 | 0.6 |
| | Adhesion Rate (%) | 60 | 70 | 70 |
| External Additive Mixing | Mixing Method | Split/Pre-addition | Split/Pre-addition | Split/Pre-addition |
| Image Evaluation | Low-temperature Fixability | A+ | C | A+ |
| | Heat-resistant Storage Stability | C | A | C |
| | Image Fog | C | A | A |
| | Photoconductor Filming | C | A | C |
| | Comprehensive Judgment | C | C | C |

Note) In the column of External Additive Mixing, "split" means that alumina and silica are mixed separately; "batch" means that alumina and silica are mixed simultaneously; "pre-addition" means that alumina is mixed first; and "post-addition" means that alumina is mixed afterwards.

It is clear from Tables 1-1 to 1-5 that the evaluation results for low-temperature fixability, heat-resistant storage stability, image fog, photoconductor filming in each Example are superior to those in each Comparative Example.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A toner, comprising:

colored particles each comprising:

a core containing a crystalline resin, a non-crystalline resin, and a colorant; and a shell layer on a surface of the core, the shell layer containing a resin and having a thickness of from 30 to 130 nm; and external additives present on surfaces of the colored particles, wherein the external additives comprise a metal oxide selected from the group consisting of one or more of an aluminum oxide, a zinc oxide, a cerium oxide, and a zirconium oxide, and a silicon compound, wherein an electronegativity X(A) of the metal oxide and an electronegativity X(Si) of the silicon compound satisfy a relation $0.5 \leq X(A)/X(Si) \leq 0.8$, wherein a proportion of an amount of the metal oxide directly adhered to the surfaces of the colored particles to a total amount of the metal oxide present on the colored particles is from 60% to 90% by mass.

2. The toner according to claim 1, wherein the resin comprises sty reneacrylic resin particles having a volume average particle diameter of from 30 to 80 nm.

3. The toner according to claim 1, wherein the metal oxide has a sphericity of 0.5 or more, the sphericity determined from the following formula:

$$\text{Sphericity}=4\pi A/L^2$$

where $\pi$ represents a ratio of a circumference of a circle to a diameter of the circle, A represents an area of a projected image of a particle of the metal oxide, and L represents a circumferential length of the projected image.

4. The toner according to claim 1, wherein the amount of the metal oxide is from 0.2 to 1.0 parts by mass with respect to 100 parts by mass of the colored particles.

5. A toner, comprising:

colored particles each comprising:

a core containing a crystalline resin, a non-crystalline resin, and a colorant; and a shell layer on a surface of the core, the shell layer containing a resin and having a thickness of from 30 to 130 nm; and external additives present on surfaces of the colored particles, the external additives comprising a metal oxide and a silicon compound, wherein an electronegativity X(A) of the metal oxide and an electronegativity X(Si) of the silicon compound satisfy a relation $0.5 \leq X(A)/X(Si) \leq 0.8$, wherein a proportion of an amount of the metal oxide directly adhered to the surfaces of the colored particles to a total amount of the metal oxide present on the colored particles is from 60% to 90% by mass, and wherein the metal oxide comprises at least one member selected from the group consisting of aluminum oxide, zinc oxide, cerium oxide, and zirconium oxide.

6. The toner according to claim 5, wherein the metal oxide is aluminum oxide and the silicon compound is silicon oxide.

7. The toner according to claim 1, wherein the crystalline resin is a crystalline polyester resin and the non-crystalline resin is a non-crystalline polyester resin.

8. A method for manufacturing the toner according to claim 1, comprising the steps of:

(a) externally adding the metal oxide to the surfaces of the colored particles; and (h) externally adding the silicon compound to the surfaces of the colored particles after the step (a).

9. A developer, comprising:

the toner according to claim 1; and a carrier.

10. A toner accommodating unit, comprising:

a container; and the toner according to claim 1 accommodated in the container.

11. An image forming apparatus, comprising:

an electrostatic latent image bearer;

an electrostatic latent image forming device configured to form an electrostatic latent image on the electrostatic latent image bearer; and a developing device containing the developer according to claim 9, configured to develop the electrostatic latent image formed on the electrostatic latent image bearer with the developer to form a visible image.

12. An image forming method, comprising:

forming an electrostatic latent image on an electrostatic latent image bearer; and developing the electrostatic latent image formed on the electrostatic latent image bearer with the developer according to claim 9 to form a visible image.

13. The toner according to claim 5, wherein the metal oxide has a sphericity of 0.5 or more, the sphericity determined from the following formula:

$$\text{Sphericity}=4\pi A/L^2$$

where π represents a ratio of a circumference of a circle to a diameter of the circle, A represents an area of a projected image of a particle of the metal oxide, and L represents a circumferential length of the projected image.

14. The toner according to claim 5, wherein the amount of the metal oxide is from 0.2 to 1.0 parts by mass with respect to 100 parts by mass of the colored particles.

15. The toner according to claim 5, wherein the crystalline resin is a crystalline polyester resin and the non-crystalline resin is a non-crystalline polyester resin.

16. The toner according to claim 5, Wherein the resin comprises styrene-acrylic resin particles having a volume average particle diameter of from 30 to 80 nm.

17. The toner according to claim 6, wherein the amount of the metal oxide is from 0.2 to 1.0 parts by mass with respect to 100 parts by mass of the colored particles.

18. The toner according to claim 17, wherein the crystalline resin is a crystalline polyester resin and the non-crystalline resin is a non-crystalline polyester resin.

19. The toner according to claim 18, wherein the resin comprises styrene-acrylic resin particles having a volume average particle diameter of from 30 to 80 nm.

20. The toner according to claim 19, wherein the metal oxide has a sphericity of 0.5 or more, the sphericity determined from the following formula:

$$\text{Spheric}=4\pi A/L^2$$

Where π represents a ratio of a circumference of a circle to a diameter of the circle, A represents an area of a projected image of a particle of the metal oxide, and L represents a circumferential length of the projected image.

* * * * *